United States Patent [19]

Nagaishi

[11] Patent Number: 4,922,877

[45] Date of Patent: May 8, 1990

[54] SYSTEM AND METHOD FOR CONTROLLING FUEL INJECTION QUANTITY FOR INTERNAL COMBUSTION ENGINE

[75] Inventor: Hatsuo Nagaishi, Kanagawa, Japan

[73] Assignee: Nissan Motor Company, Limited, Japan

[21] Appl. No.: 360,813

[22] Filed: Jun. 2, 1989

[30] Foreign Application Priority Data

| | | | |
|---|---|---|---|
| Jun. 3, 1988 | [JP] | Japan | 63-136699 |
| Jun. 3, 1988 | [JP] | Japan | 63-136700 |
| Jun. 29, 1988 | [JP] | Japan | 63-162909 |

[51] Int. Cl.[5] ..... F02B 3/02; F02D 41/10; F02M 51/00

[52] U.S. Cl. ..... 123/478; 123/480; 364/431.05

[58] Field of Search ..... 123/478, 480, 492, 493; 364/431.05

[56] References Cited

U.S. PATENT DOCUMENTS

| | | | |
|---|---|---|---|
| 4,092,905 | 12/1987 | Sekozawa et al. | 364/431.05 |
| 4,705,001 | 11/1987 | Darro et al. | 123/478 |
| 4,753,206 | 6/1988 | Inoue et al. | 123/480 |
| 4,821,698 | 4/1989 | Atago et al. | 123/478 |
| 4,836,169 | 6/1989 | Ishikawa et al. | 123/480 |

FOREIGN PATENT DOCUMENTS

| | | | |
|---|---|---|---|
| 58-8238 | 1/1983 | Japan | 123/478 |
| 58-104335 | 6/1983 | Japan | 123/478 |
| 59-101556 | 6/1984 | Japan | 123/478 |
| 63-38635 | 2/1988 | Japan | 123/478 |
| 64-3245 | 1/1989 | Japan | 123/478 |

*Primary Examiner*—Raymond A. Nelli

*Attorney, Agent, or Firm*—Lowe, Price, LeBlanc, Becker & Shur

[57] ABSTRACT

A system and method for controlling quantity of fuel injected to an internal combustion engine are disclosed in which a characteristic having a correlation to part of fuel supply quantity from an injector which has been supplied toward a wall surface of an intake air passage of the engine has been adhered onto the wall surface and will be brought away from the wall surface into a combustion chamber during a suction stroke at the present fuel injection timing is derived so that a correction quantity for a quantity of injected fuel is calculated on the basis of the derived characteristic. Therefore, an air-fuel mixture ratio when the engine falls in a transient state is not deviated from a target air-fuel mixture ratio so that an exhaust gas emission characteristic can be improved.

39 Claims, 15 Drawing Sheets

CHANGE IN AIR QUANTITY

AIR QUANTITY
TAU-Tp BY KATHOS

QUANTITY OF INJECTED FUEL IN THE CASE OF BB
CHOSN ERACIN

KATHOS
QUANTITY OF INJECTED FUEL IN THE CASE OF AA

BB
AIR-FUEL MIXTURE RATIO
LEAN
RICH
AA

SYSTEM AND METHOD FOR CONTROLLING FUEL INJECTION QUANTITY FOR INTERNAL COMBUSTION ENGINE

BACKGROUND OF THE INVENTION (1) Field of the invention

The present invention relates to a system and method for controlling fuel injection for an internal combustion engine mounted in a vehicle and particularly relates to the system and method for controlling fuel injection for the internal combustion engine which provide a flat characteristic for an air-fuel mixture ratio even at the time of an engine transient operating condition.

(2) Background of the art

It is necessary to control fuel supply quantity with good responsive characteristic according to a degree of engine output power requirement when an output power required for a vehicular engine is changed. The result of the fuel supply quantity control affects an air-fuel mixture ratio particularly during an engine transient operating condition and affects engine operating performance such as a drive feeling and exhaust gas composition.

In general, a deviation of the air-fuel mixture ratio from a target air-fuel mixture ratio during an acceleration/deceleration of the engine is caused by a change in quantity of fuel adhered or floating onto or around a wall surface of intake manifold or intake port of an intake air passage. Such fuel quantities adhered and left on or around the wall surface are largely changed according to the engine operating condition.

A Japanese Patent Application First (non-examined) Publication Showa 58-104335 published on June 21, 1983 exemplifies a previously proposed fuel injection quantity controlling system for an internal combustion engine.

In the above-mentioned Japanese Patent Application First Publication, the fuel injection quantity controlling system derives a required load from an output of an airflow meter installed on an upstream of an engine throttle valve and calculates fuel injection quantity from the required engine load.

In addition, during the engine transient state (,e.g., acceleration), the fuel injection quantity is corrected by a transient state correction quantity, with quantities of fuel flowing toward a wall surface of a passage of an intake manifold and/or of an intake port (so-called, wall current) taken into account. It is noted that the transient state correction quantity is a correction quantity to correct the fuel injection quantity and derived for compensating for the quantity of fuel flowing toward the wall surface of the intake manifold and/or intake air port (wall current).

The transient state correction quantity is not only used during the engine acceleration and deceleration but also used for the correction of fuel injection quantity upon a fuel recovery immediately after a fuel cut-off or for that upon an engine start. Such transient operating conditions described above will have a great influence on the quantity of the wall current.

However, in the previously proposed fuel injection quantity controlling system and method, the quantity of fuel flowing toward the wall surface which provides a basis for calculating the transient state correction quantity is derived only on a basis of an output of an engine coolant temperature sensor (,i.e., engine coolant temperature). Therefore, a sufficient correction of fuel quantity at the time of such transient operating conditions as described above cannot be carried out by the transient state correction quantity.

That is to say, although a temperature at the wall surface of such a fuel-adhered portion of the intake air passage is an essential parameter to determine vaporization of the wall current, the temperature at the fuel-adhered portion is largely varied for different engine operating conditions, as shown in a characteristic graph of FIG. 6. In addition, delay time constants of the temperature increase and/or decrease at the wall surface are provided for different engine operating conditions, as shown in a characteristic graph of FIG. 7.

In other words, since a gradient of increasing the temperature at the fuel-adhered portion becomes different depending on the engine operating condition, this appears as the difference of the delay time constant. Hence, since the temperature of the wall surface at the fuel-adhered portion becomes different depending on the engine operating condition before the acceleration, the engine driveability becomes worsened due to an inappropriate air-fuel mixture ratio during the transient operating condition such as acceleration and/or deceleration.

Particularly, in the engine of a multi-point injection type in which a quantity of fuel is directly injected toward an intake valve 32 in a cylinder head 31 by means of a fuel injection valve (fuel injector) A, as shown in FIG. 10, and in which a quantity of fuel is injected toward a wall surface of the intake port by means of a fuel injector B, as shown in FIG. 10, change patterns of the air-fuel mixture ratios after the engine has started in both types of the multi-point injections are different from each other and the change of the air-fuel mixture ratio in the case where the fuel is directly injected toward the intake valve 32 is more remarkable.

That is to say, an error of an air-fuel mixture ratio due to a temperature at the fuel-adhered portion, i.e., the intake valve 32 is large and such a phenomenon as described above does not only occur at a time immediately after the engine has started but also tends to occur, e.g., at a time immediately after the fuel supply is resumed after the fuel cut-off.

Hence, during the acceleration, a, so-called, hesitation easily occurs. In addition, a deviation of the air-fuel mixture ratio from a three (ternary) -catalytic point in a CCRO (catalytic converter rthodium) or CCO (catalytic converter oxidation) occurs due to the variation of the air-fuel mixture ratio so that the exhaust gas clarification characteristic of the engine is reduced.

It is noted that although a sensor, e.g., for detecting a temperature on the fuel-adhered portion (wall surface) may be installed on the wall surface or other position to detect the temperature at the fuel-adhered portion, this results in the increased cost of mounting such a sensor and this introduces poor productivity of installing the fuel injection controlling system in the engine.

A Japanese Patent Application First (non-examined) Publication No. Showa 59-101556 published on June 12, 1984 exemplifies another previously proposed fuel injection controlling system for the internal combustion engine.

In the other previously proposed fuel injection controlling system disclosed in JP-Al-59-101556, a basic fuel injection quantity $T_p$ is calculated on the basis of an intake air quantity $Q_a$ and engine revolutional speed N. In addition, an opening angle of an engine throttle valve is detected. When the opening angle of the throttle valve increases at a rate exceeding a constant valve, a temporary addition of fuel (interrupt fuel injection) is immediately executed independently of the basic fuel injection quantity so that an incremented correction of fuel quantity is executed according to a degree of acceleration and an insufficient quantity of the basic fuel injection quantity $T_p$ due to a response delay of measured intake air quantity at the time of abrupt acceleration is compensated for by means of the interrupt fuel injection determined according to the angular displacement of the throttle valve.

However, in the above-described other fuel injection quantity controlling system disclosed in JP-Al-59-101556, the quantity of fuel injected during a suction stroke or immediately after the start of the suction stroke is hardly sucked into the corresponding cylinder (combustion chamber) during its suction stroke and largely sucked into the corresponding cylinder during the subsequent suction stroke. Therefore, the fuel injection quantity controlling system cannot take a full advantage of an asynchronization (interrupt) fuel injection described above. Even if a pulsewidth of an injection signal supplied to the fuel injector is widened, the air-fuel mixture ratio appearing at the second suction stroke becomes too rich.

A Japanese Patent Application First (non-examined) Publication Showa 64-3245 published on Jan. 9, 1989 exemplifies an air-fuel mixture ratio controlling system which comprises: (a) first means for determining whether the asynchronization fuel injection should be carried out independently of the synchronization fuel injection for each rotation of the engine on the basis of a quantity of change in a signal representing an engine operating condition; (b) second means for calculating an asynchronization fuel injection quantity for each cylinder on the basis of the quantity of change of the engine operating condition signal when the asynchronization fuel injection is carried out; (c) third means for calculating a percentage of correction of the asynchronization fuel injection quantity for each cylinder according to a cycle position signal at that time when the asynchronization fuel injection should be carried out; (d) fourth means for correcting the asynchronization injection quantity from the calculated correction percentage; and (e) fifth means for actuating the fuel injection valve for each cylinder in response to a drive signal which corresponds to the corrected asynchronization fuel injection quantity.

The above-described air-fuel mixture ratio controlling system disclosed in JP-Al-64-3245 can considerably eliminate deviations of the air-fuel mixture ratio from a target air-fuel mixture ratio for respective cylinders with differences of wait time intervals from the occurrence of the asynchronization fuel injection to the entrance of the suction stroke immediate after the asynchronization fuel injection taken into account.

In addition, the engine driveability can be assured and exhaust gas clarification characteristic with misfire and torque reduction can be improved.

Although the above-described air-fuel mixture ratio controlling system disclosed in JP-Al-64-3245 supplies a smaller amount of fuel injected at the time of the subsequent synchronization fuel injection so as to compensate for an extra quantity of fuel injected at the time of asynchronization fuel injection in order to prevent richer air-fuel mixture ratio, it was confirmed that the richer and leaner the air-fuel mixture ratios were generated individually for the respective cylinders, a, so-called, glitch appeared in the emission characteristic (the whole air-fuel mixture ratio indicated no flat characteristic), and an improvement in a catalytic effect of the three catalytic converter (CCRO or CCO) was needed.

Furthermore, a Japanese Patent Application First (non-examined) Publication No. Showa 58-8238 published on Jan. 18, 1983 exemplifies a previously proposed fuel injection quantity controlling method for a fuel-injection type engine.

In the above-described proposed fuel injection quantity controlling method disclosed in JP-Al-58-8238, a quantity of fuel adhered to the wall surface is estimated and calculated according to the quantity of fuel injected through the fuel injection valve, assuming that the quantity of fuel adhered to the wall surface and the quantity of fuel brought away from the wall surface into a combustion chamber of the corresponding cylinder during the suction stroke are changed according to the quantity of injected fuel.

Then, the calculated quantity of fuel adhered onto the wall surface is accumulated to derive the quantity of fuel brought away from the wall surface into the combustion chamber. Then, the quantity of fuel brought into the combustion chamber is subtracted from the calculated quantity of fuel adhered onto the wall surface and is added to the synchronization fuel injection quantity to derive an actually executed fuel injection quantity. That is to say, when the quantity of fuel adhered onto the wall surface is large, the synchronization quantity of fuel is increased and when the quantity of fuel brought into the combustion chamber from the wall surface is great, the synchronization fuel injection quantity is reduced to suppress the variation of air-fuel mixture ratio.

In the above-described previously proposed fuel injection quantity controlling system disclosed in the JP-Al-58-8238, the fuel injection correction quantity is corrected for a behavior of the wall current which is changed with a relatively slow time constant (so-called, a low-frequency wall current component).

However, since no correction is carried out for the behavior of the wall current which is changed with a relatively high-speed time constant (so-called, high-frequency wall current component), the following problem occurs.

That is to say, during a slow acceleration such that no interrupt injection (asynchronization fuel injection) is needed, the air-fuel mixture ratio (A/F) at the time of a first suction stroke in which the acceleration is started becomes slightly lean. This is because the rate of the incremented quantity of fuel is large which has directed as the wall current when the timing at which the synchronization fuel injection occurs immediately before the suction stroke.

In addition, when the injection timing is too early with respect to the suction stroke, the air-fuel mixture ratio becomes lean due to the injection carried out in response to an old air quantity indicative signal derived from the airflow meter.

SUMMARY OF THE INVENTION

It is, therefore, an object of the present invention to provide a cost-reduced system and method for controlling a fuel injection quantity for a vehicular engine which can provide a substantially flat characteristic for an air-fuel mixture ratio of each engine cylinder even during a transient state of a vehicular engine and improve an exhaust gas emission characteristic.

It is another object of the present invention to provide the system and method for controlling the fuel injection quantity for the vehicular engine which can minimize a deviation of air-fuel mixture ratio from a target air-fuel mixture ratio and improve an engine driveability even during the transient operating state.

It is still another object of the present invention to provide the system and method for controlling the fuel injection quantity for the vehicular engine which achieve an appropriate correction of the quantity of injected fuel even during the transient operating state.

In a first preferred embodiment, a temperature at a fuel-adhered portion of an engine intake air passage is appropriately predicted to estimate a quantity of the injected fuel flowing toward the wall surface of the intake passage (wall current) when the engine falls in the transient operating state (engine acceleration/deceleration, immediate after the engine has started, and immediate after the fuel recovery upon a fuel cut-off) so that an appropriate transient state correction quantity is achieved.

In a second preferred embodiment, the correction quantity of injected fuel used at the subsequent synchronization fuel injection is changed depending on whether an interrupt fuel injection carried out during an abrupt acceleration (asynchronization fuel injection) is late or earlier than the synchronization fuel injection corresponding timely to the subsequent suction stroke.

In a third preferred embodiment, a quantity of injected fuel executed at a syncronization fuel injection is corrected by correction quantities determined on the basis of the fuel injection timing other than a transient state correction quantity.

The above-described objects can be achieved by providing a system for controlling fuel supply quantity for an internal combustion engine, comprising: (a) first means for detecting parameters determining an engine operating condition; (b) second means for determining whether the engine falls in a transient operating state on the basis of the detected parameters; (c) third means for deriving a quantity of fuel to be supplied to each engine cylinder on the basis of the detected parameters; (d) fourth means for deriving a characteristic having a correlation to part of the quantity of fuel which has been supplied toward a wall surface of an engine intake air passage, has been adhered onto the wall surface, and will be brought into a combustion chamber of each engine cylinder during its suction stroke at the present fuel supply timing on the basis of the detected parameters; (e) fifth means for deriving a correction quantity for the quantity of fuel derived by the third means on the basis of the characteristic derived by the fourth means when the engine falls in the transient operating condition; and (f) sixth means for supplying the quantity of fuel for each cylinder which is derived by the third means and corrected by the fifth means.

The above-described objects can also be achieved by providing a system for controlling fuel supply quantity for an internal combustion engine, comprising: (a) first means for detecting parameters determining an engine operating condition; (b) second means for determining whether the engine falls in a transient operating state on the basis of the detected parameters; (c) third means for deriving a quantity of fuel to be supplied to each engine cylinder on the basis of the detected parameters; (d) fourth means for deriving a factor which provides a substantially flat characteristic for an air-fuel mixture ratio when the quantity of fuel derived by the third means is injected during the transient operating condition on the basis of the detected parameters; (e) fifth means for deriving a correction quantity for the quantity of fuel derived by the third means on the basis of the factor derived by the fourth means when the engine falls in the transient operating condition; and (f) sixth means for supplying the quantity of fuel for each cylinder which is derived by the third means and corrected by the fifth means.

The above-described objects can also be achieved by providing a system for controlling quantity of injected fuel to an internal combustion engine, comprising: (a) first means for detecting an engine operating condition; (b) second means for deriving a change quantity of an engine load and determining whether the engine falls in a predetermined transient state; (c) third means for deriving a transient state correction quantity on the basis of the change quantity of the engine load when the engine falls in the predetermined correction quantity; (d) fourth means for deriving a basic quantity of injected fuel on the basis of the engine operating condition and correcting and outputting the basic quantity of injected fuel by the transient state correction quantity when the engine falls in the predetermined transient state; (e) fifth means for deriving a factor having a correlation to a quantity of fuel adhered on a wall surface of an intake air passage and having a predetermined time constant when the engine falls in the predetermined transient state and deriving a correction coefficient on the basis of the derived factor; (g) sixth means for correcting the output fuel injection quantity by the correction coefficient and outputting the corrected fuel injection quantity; and (h) seventh means for injecting the derived and corrected quantity of fuel toward an intake air passage of the engine.

The above-described object can also be achieved by providing a method for controlling quantity of supply fuel for an internal combustion engine, comprising the steps of: (a) detecting parameters determining an engine operating condition; (b) determining whether the engine falls in a transient operating state on the basis of the detected parameters; (c) deriving a quantity of fuel to be supplied to each engine cylinder on the basis of the detected parameters; (d) deriving a characteristic having a correlation to part of the quantity of fuel which has been supplied toward a wall surface of an engine intake air passage, has been adhered onto the wall surface, and will be brought into a combustion chamber of each engine cylinder during its suction stroke at the present fuel supply timing on the basis of the detected parameters; (e) deriving a correction quantity for the quantity of fuel derived by the third means on the basis of the characteristic derived by the fourth means when the engine falls in the transient operating condition; and (f) supplying the quantity of fuel for each cylinder which is derived in the step (c) and corrected by the correction quantity derived in the step (e).

DETAILED DESCRIPTION OF THE PREFERRED EMBODIMENTS

Reference will hereinafter be made to the drawings in order to facilitate a better understanding of the present invention.

FIRST PREFERRED EMBODIMENT

Figure 1:
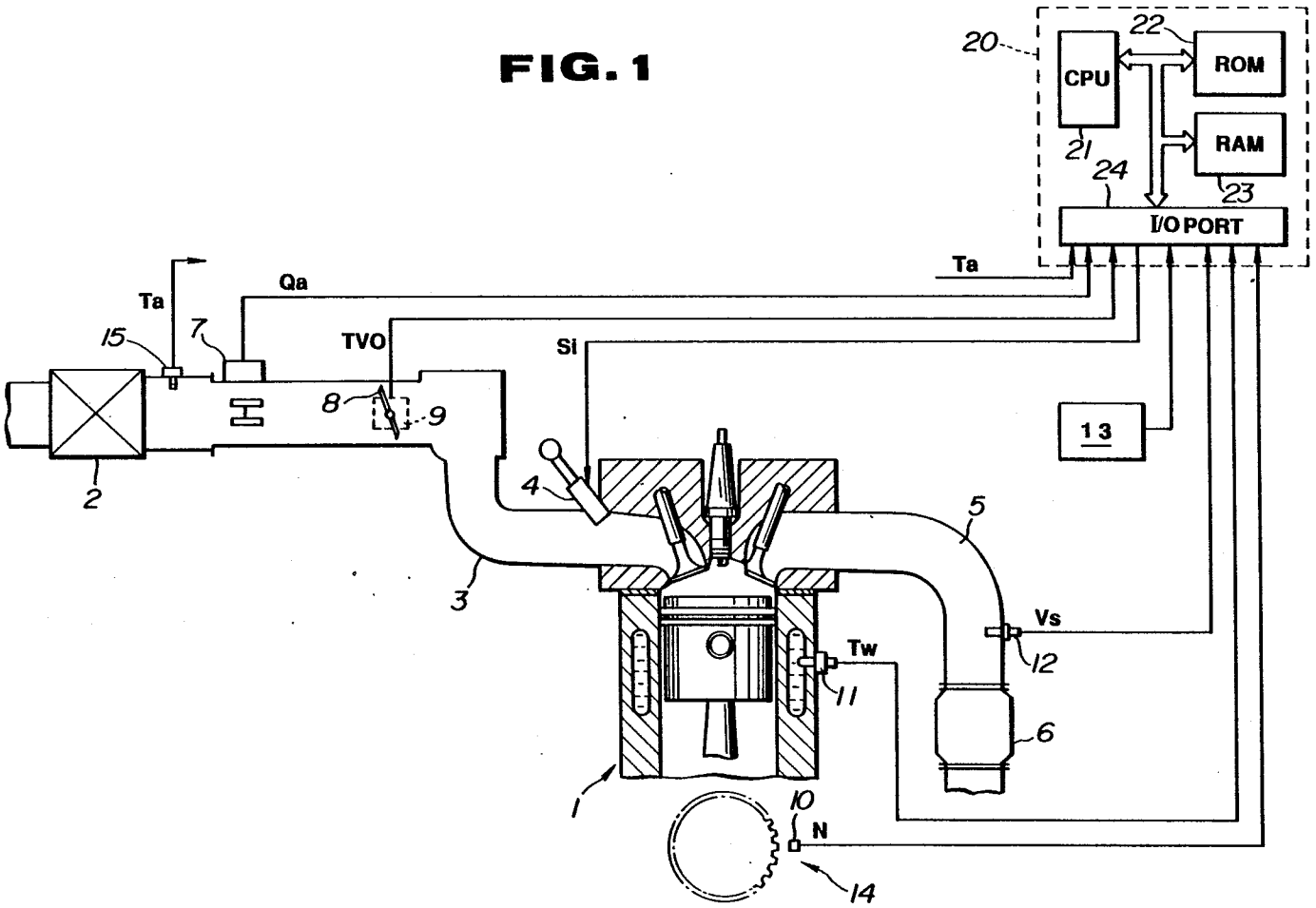
FIG. 1 is a schematic drawing of a fuel injection quantity controlling system in a first preferred embodiment according to the present invention.

FIG. 1 shows a configuration of a fuel injection controlling system in a first preferred embodiment according to the present invention.

In FIG. 1, an intake air supplied via an air cleaner 2 is passed through an intake air passage 3 and fuel is injected through a fuel injector 4 installed in the intake passage 3 on the basis of a pulsewidth of an injection signal $S_i$. Then, an exhaust gas in the corresponding engine cylinder is introduced into a catalytic converter 6 via an exhaust gas pipe 5. Harmful components (CO, HC, $NO_x$) in the exhaust gas are clarified and exhausted through the catalytic converter 6 by means of a CCRO (catalytic converter rhodium).

A flow quantity $Q_a$ of the intake air is detected by means of an airflow meter 7 of a hot wire type and is controlled by means of a throttle valve 8 installed in the intake air pipe 3.

An opening angle TVO of the throttle valve 8 is detected by means of a throttle valve opening angle sensor 9. A number of engine revolutions per time (RPM) of the engine 1 is detected by means of a crank angle sensor 10. A temperature of the coolant $T_w$ flowing through a water jacket is detected by means of a coolant temperature sensor 11. An oxygen concentration in the exhaust gas is sensed by means of an oxygen sensor ($O_2$ sensor) 12. The oxygen sensor 12 is constituted by an element having a characteristic such that the air-fuel mixture ratio is widely detected in a range from a rich to lean including a stoichiometric air-fuel mixture ratio.

The structure of the oxygen sensor 12 is exemplified by a Japanese Patent Application First Publication showa 61-241434 published on Oct. 27, 1986, the disclosure of which is hereby incorporated by reference.

An intake air temperature sensor 15 is installed in the intake air passage 3 for detecting an intake air temperature Ta.

A start switch 13 is used to detect the operation of a starter motor.

The structure of the airflow meter 7 is exemplified by U.S. Pat. No. 4,331,042 issued on Jan. 19, 1982, the disclosure of which is hereby incorporated by reference.

The airflow meter 7, the intake air temperature sensor 15, the throttle valve opening angle sensor 9, crank angle sensor 10, coolant temperature sensor 11, oxygen sensor 12, and start switch 13 constitute engine operating condition detecting means 14. The outputs derived from the engine operating condition detecting means 14 are transmitted to a control unit 20.

The control unit 20 is constituted by a microcomputer having a CPU (Central Processing Unit) 21, ROM (Read Only Memory) 22, RAM (Random Access Memory) 23, and I/O Port 24.

The CPU 21 fetches a required external data via the I/O Port 24 in accordance with programs written into the ROM 22 and transfers data with the RAM 23 to calculate and process the processed value required for the fuel injection control. Then, the CPU 21 outputs the data processed according to its necessity via the I/O Port 24. The I/O Port 24 receives the signals derived from the engine operating condition detecting means 14 and outputs the fuel injection signal $S_i$ to the corresponding fuel injector 4.

The ROM 22 stores arithmetic operation programs, as will be described later, on the basis of which the CPU 21 operates and stores data and instructions used for various calculations through the CPU 21 in the form of table maps.

Next, an operation of the fuel injection quantity controlling system in the first preferred embodiment will be described with reference to FIGS. 2 to 11.

Figure 2:
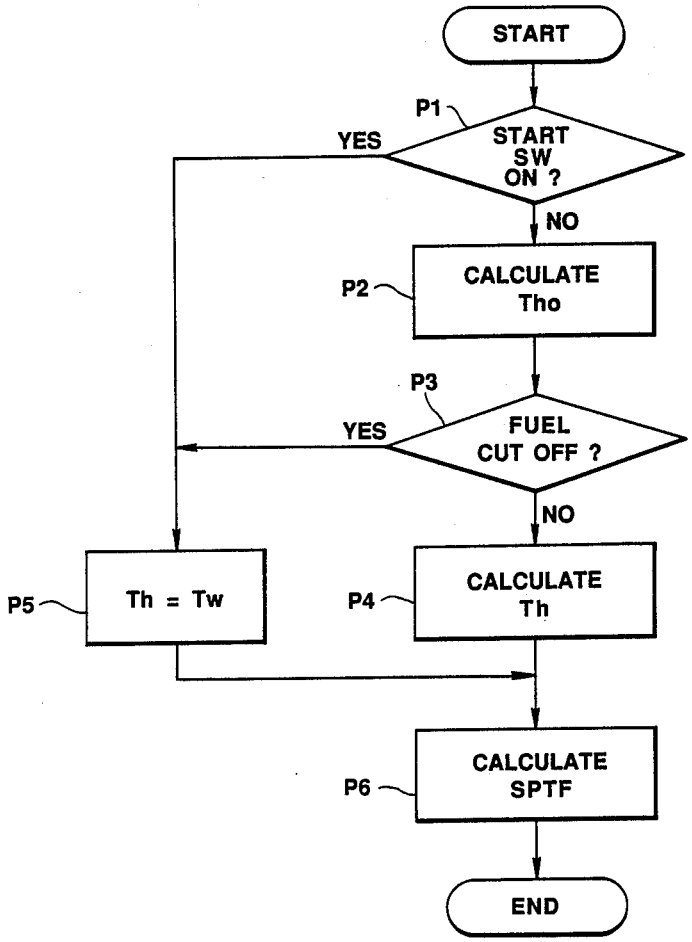
FIG. 2 is an operational flowchart for explaining calculations of a temperature on a fuel-adhered portion and of a delay time constant in the first preferred embodiment shown in FIG. 1.

FIG. 2 shows a program for calculating a temperature at a fuel-adhered portion on the intake air passage 3 (hereinafter, referred to as a fuel-adhered portion temperature) $T_h$ and delay time constant SPTF.

The program shown in FIG. 2 is executed in synchronization with a timer and executed once for, e.g., each one second.

In a step $P_1$, the CPU 21 determines whether the start switch 13 is turned ON. When the start switch 13 is turned ON in the step $P_1$, the CPU 21 determines that the engine 1 is cranked. Then, the routine goes to a step $P_6$ in which the fuel-adhered portion temperature Th is determined to be equal to the coolant temperature Tw at that time (Th=Tw). On the other hand, when the start switch 13 is not turned ON in the step $P_1$, the CPU 21 determines that the cranking has already been ended since an engine ignition has already started. Then, the routine goes to a step $P_2$ in which the CPU 21 derives an equilibrium fuel-adhered portion temperature Tho on the fuel-adhered portion. The equilibrium fuel-adhered temperature Tho is calculated by looking up a table map shown in FIG. 6 on the basis of parameters of the engine operating condition, i.e., an instantaneous intake air quantity Qcyl (the same table map may be prepared when the intake air quantity is replaced with the intake air negative pressure) and the engine revolutional speed N.

It is noted that Qcyl denotes the intake air quantity sucked into one cylinder and corresponds to the engine load L.

Figure 6:
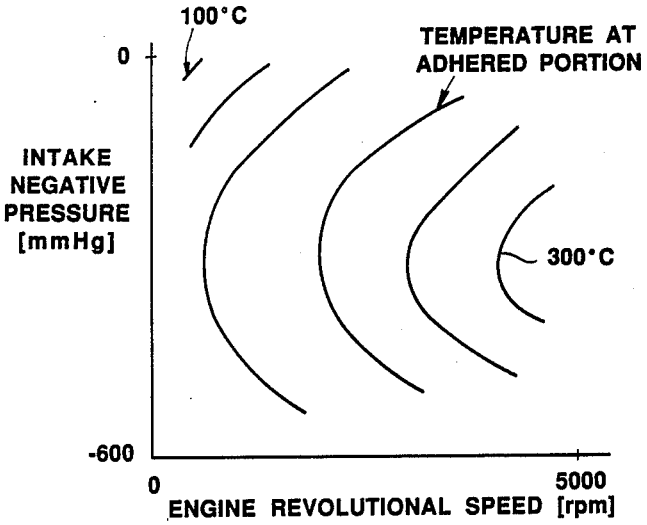
FIG. 6 is a characteristic graph for explaining a characteristic of a temperature at the fuel-adhered portion of a wall surface of an intake air passage.
Figure 7:
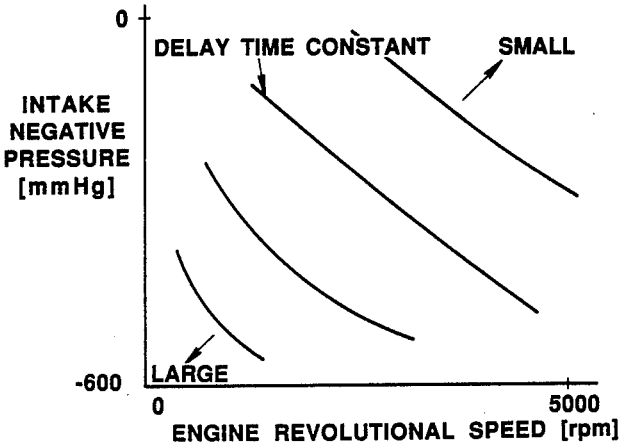
FIG. 7 is a characteristic graph for explaining a delay time constant in the first preferred embodiment.

The table map shown in FIG. 7 is prepared through an experiment and the equilibrium temperature shown in FIG. 6 matches precisely with an actual equilibrium fuel-adhered portion temperature Tho.

Next, in the step $P_3$, the CPU 21 determines whether the fuel is being cut off. When the fuel is being cut off in the step $P_3$, the routine goes to the step $P_5$. When the fuel is not being cut off, the routine goes to a step $P_4$. The method of controlling the cut off of the fuel supply to the engine is exemplified by a U.S. Pat. No. 4,395,984 issued on August 2, 1983, the disclosure of which is hereby incorporated by reference.

The CPU 21 calculates the fuel-adhered portion temperature Th in accordance with the following equation (1).

$$Th = Tho - (80 - T_w) \times Cl - (25 - T_a) \times C2 \quad (1)$$

In the equation (1), C1 and C2: constants $T_w$: coolant temperature $T_a$: intake air temperature Thus, the fuel-adhered portion temperature Th can accurately be determined which corresponds to the instantaneous engine operating condition on the basis of the equilibrium fuel-adhered portion temperature Tho.

Next, in the step $P_6$, the CPU 21 looks up the delay time constant SPTF from the table map shown in FIG. 7 on the basis of the engine operation condition, i.e., intake air quantity Qcyl (or intake negative pressure) and the engine revolutional speed N.

The delay time constant SPTF corresponds to the change speed of the fuel-adhered portion temperature Th and is represented in a percentage (%) in FIG. 7.

Figure 3:
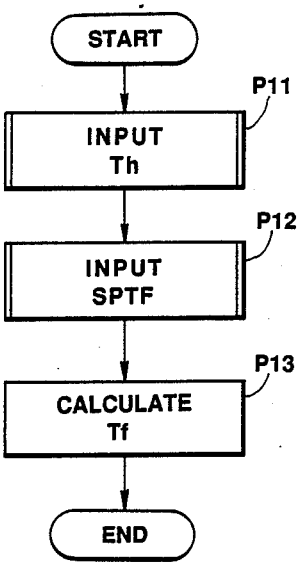
FIG. 3 is an operational flowchart for explaining a calculation of a predicted value of the temperature on the fuel-adhered portion.

FIG. 3 shows a program flowchart for calculating a predicted value Tf (hereinafter, referred to as a predicted value) of the temperature at the fuel-adhered portion of the wall surface. The program shown in FIG. 3 is executed for, e.g., each one second.

In steps $P_{11}$ and $P_{12}$, the CPU 21 reads the temperature Th at the fuel-adhered portion and delay time constant SPTF derived in the subroutine shown in FIG. 2 and calculates the predicted value Tf in accordance with the following equation (2):

$$T_f = Th \times SPTF + T_{f-1} \times (1 - SPTF) \quad (2)$$

In the equation (2), $T_{f-1}$: previous value of Tf.

The predicted value Tf of the temperature at the fuel-adhered portion is derived as a first order lag of the fuel-adhered portion temperature using the calculation of the fuel-adhered portion temperature Th.

Figure 4:
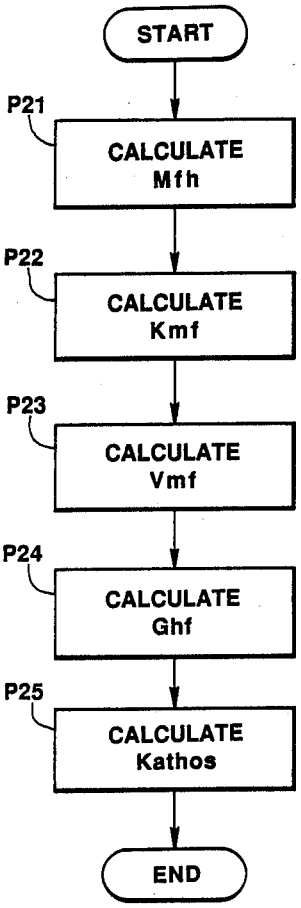
FIG. 4 is an operational flowchart for explaining a calculation of a transient state correction quantity of fuel in the first preferred embodiment.

FIG. 4 shows a program flowchart for calculating a transient state correction quantity Kathos.

The program flowchart shown in FIG. 4 is executed once for 10 milliseconds.

First, the CPU 21 derives an equilibrium quantity of fuel Mfh by which the quantity of fuel flows toward the wall surface as the wall current within the intake air passage 3.

For example, the correction quantity based on the predicted value Tf of the temperature at the fuel-adhered portion is added to the result of the following equation (3).

$$Avtp \times Mfhtvo \quad (3)$$

In the above equation (3), Avtp denotes a smooth quantity of fuel injected through the fuel injector 4, is derived in such a way that the output of the airflow meter 7 is smoothed in the first order lag in order to precisely derive the quantity of intake air passing through a location of the fuel injector 4, and is derived as the fuel injection quantity on the basis of the smooth air quantity thus calculated.

Hence, the smooth quantity of fuel denoted by Avtp is calculated as a pulsewidth (ms.) corresponding to the quantity of air sucked into a corresponding engine cylinder. It is noted that the method of calculating Avtp will be described later with reference to FIG. 12.

On the other hand, Mfhtvo denotes a multiplying factor corresponding to quantity of fuel occupied to that flowing toward the fuel-adhered portion and is derived according to the engine load L and engine revolutional speed N for each coolant temperature Tw.

Since in the processing described above the predicted value Tf of the fuel-adhered portion temperature is used for the calculation of the equilibrium quantity of adhered fuel Mfh as is different from the conventional method of fuel injection controlling system, the accuracy of the equilibrium fuel-adhered portion quantity of fuel Mfh becomes high.

Next, in a step $P_{22}$, a rate of quantity of fuel Kmf [%] divided into the fuel-adhered fuel quantity is derived.

For example, a correction quantity based on the predicted value Tf of the temperature at the fuel-adhered portion is added to the following equation (4).

$$Kmfat \times Kmfn \quad (4)$$

In the equation (4), Kmfat denotes a rate (%) of basic divided fuel injection quantity and is derived from a predetermined table map using $\alpha-N$ flow quantity Qho and coolant temperature Tw with a calculation of interpolation.

It is noted that $\alpha-N$ flow quantity is used to derive the air quantity from the opening angle of the throttle valve TVO and engine revolutional speed N.

In addition, Kmfn (multiplying factor) denotes a rotational correction percentage of the rate of divided quantity and is derived from a predetermined table map using the revolutional speed N with the interpolation calculation.

Since the predicted value Tf of the temperature at the fuel-adhered portion is used when calculating the rate of divided quantity Kmf as is different from the conventional fuel injection controlling method, the accuracy of the calculation becomes high.

Next, a speed of quantity of fuel reaching the fuel-adhered portion Vmf [ms.] is calculated in accordance with the following equation (5).

$$Vmf=[Mfh-Mf]\times Kmf \quad (5)$$

In the equation (5), Mf denotes the quantity of the fuel adhered onto the fuel-adhered portion and is derived from, e.g., the following equation (6).

$$Mf=(Mf-1\ \mathrm{ref})+Vmf \quad (6)$$

(Mf−1 ref) denotes a quantity of fuel adhered onto the fuel-adhered portion before one revolution (the time before previous injection time).

The fuel-adhered speed Vmf denotes a flow quantity of fuel flowing as the wall current and is derived as the flow quantity of fuel per revolution. The method of deriving Vmf is exemplified by a Japanese Patent Application First Publication No. showa 63-38635 published on Feb. 19, 1988, the disclosure of which is hereby incorporated by reference. That is to say, the value of Vmf is derived as a difference of $Mf_1$ and $Mf_2$ which are derived with the parameters of air quantity passing through the fuel injector $Q_{ainj}$, engine revolutional speed N, and coolant temperature Tw.

Next, in a step $P_{24}$, the percentage of correction Ghf (%) is derived in accordance with the following equation (7).

$$Ghf=Ghfgen\times KtgKL \quad (7)$$

In the equation (7), Ghfgen denotes the correction percentage of reduced quantity. During the acceleration ($Vmf\geqq 0$), Ghfgen=0. If not ($Vmf<0$), one of either a correction percentage load term Ghfg or Ghfdn which is larger than the other is used as Ghfgen.

It is noted that Ghfgen is derived through a table look up technique on the basis of the smooth quantity of injected fuel Avtp. KtgKL denotes a low-frequency coefficient of a transient learning. For example, its value is about 1.0.

In the step $P_{25}$, a transient state correction quantity Kathos is derived in accordance with the following equation (8).

$$Kathos=Vmf\times Ghf \quad (8)$$

The other method of deriving Kathos is exemplified by a Japanese Patent Application First Publication No. Showa 63-38635 published on Feb. 19, 1989, the disclosure of which is hereby incorporated by reference.

Figure 5:
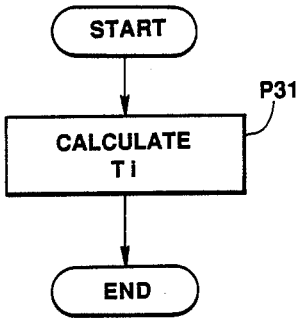
FIG. 5 is an operational flowchart for explaining a calculation of a fuel injection quantity.

After Kathos is derived in the above-described processing, the actual quantity of injected fuel Ti is derived in accordance with the following equation (9) in a step $P_{31}$ of a program flowchart shown in FIG. 5.

$$Ti=(Tp\times\alpha m+Kathos)\times\alpha+T_s \quad (9)$$

In the equation (9), $T_p$ denotes a basic quantity of fuel, as will be described later, $\alpha$ denotes a correction coefficient of $\lambda$ control of the air-fuel mixture ratio on the basis of the output of the oxygen sensor 12, $\alpha m$ denotes a correction coefficient of a learning control on the air-fuel mixture, and $T_s$ denotes a non-effective pulse-width of the injection signal $S_i$ as will be described later.

Figure 8:
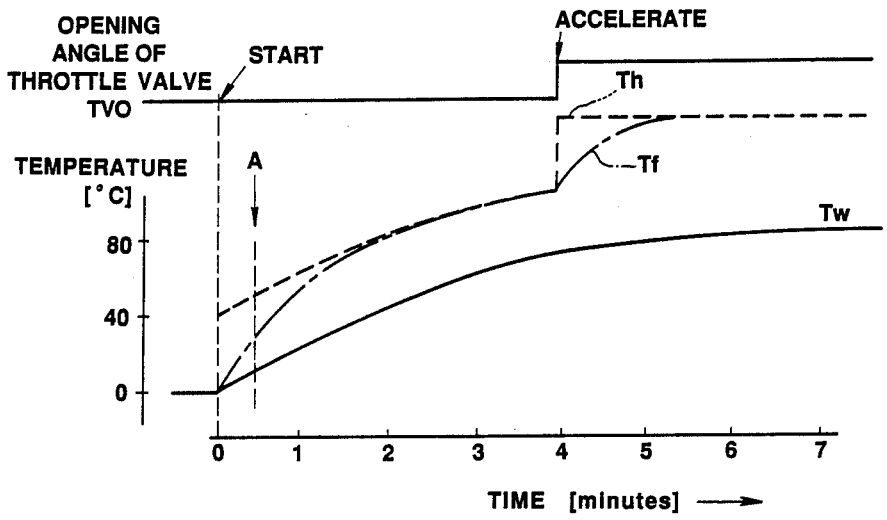
FIG. 8 is a timing chart for explaining an action of the first preferred embodiment during a start of the engine.

FIG. 8 shows an actual operation of the first preferred embodiment as the result of the execution of each program shown in FIGS. 2 through 5.

FIG. 8 exemplifies a case wherein the vehicle is accelerated at a time when about four (4) minutes have passed after the engine 1 has started.

Since the temperature Th of the wall current at the fuel-adhered portion is a value derived in a case where the temperature thereat is equilibarated in a steady state, the temperature Th thereof at the fuel-adhered portion is increased in a step-wise at the same time when the engine 1 has started and is increased in the step-wise during the acceleration as denoted by a broken line of FIG. 8.

However, such a step-wise change as shown in FIG. 8 does not match with the actual temperature thereof at the fuel-adhered portion.

On the other hand, since the predicted value Tf of the fuel-adhered portion temperature is used in the first preferred embodiment, the value Tf is accurately mated with the actual fuel-adhered portion temperature as appreciated from FIG. 8.

Figure 9:
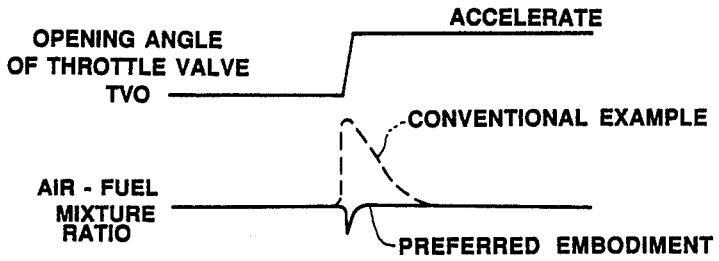
FIG. 9 is a timing chart for explaining a variation of an air-fuel mixture ratio during the acceleration.
Figure 10:
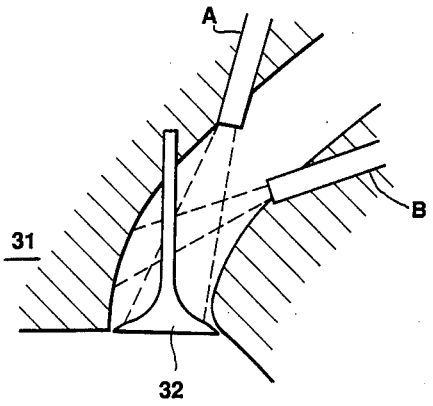
FIG. 10 is a schematic drawing of positions of fuel injectors in previously proposed fuel injection quantity controlling systems.
Figure 11:
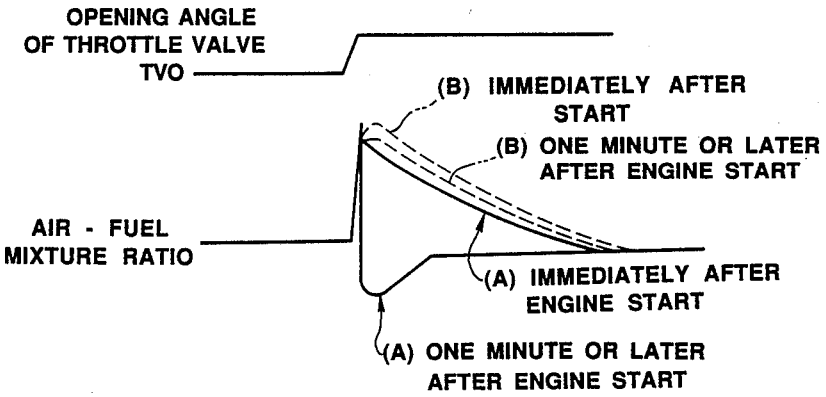
FIG. 11 is a timing chart for explaining a variation of the air-fuel mixture ratio during the acceleration in the previously proposed fuel injection controlling system.

Particularly, a change pattern in the air-fuel mixture ratio in the case where such an acceleration as detected by the opening angle TVO of the throttle valve is carried out at a time denoted by A in FIG. 8 is shown in FIG. 9.

Since the temperature of the wall current at the fuel-adhered portion is derived from the coolant temperature Tw in the previously proposed fuel injection controlling system, the value of the transient state correction quantity Kathos becomes inappropriate and the air-fuel mixture ratio is largely varied as denoted by a broken line in FIG. 9.

On the other hand, in the first preferred embodiment, since the predicted value Tf thereof at the fuel-adhered portion is used as is different from the case where the time constant is extremely large as in the case of the temperature Tw of the coolant and the temperature is equilibrated in the steady state, the correction of the wall current is appropriately carried out so that the transient state correction quantity accurately corresponds to the actual situation. Hence, the change in the air-fuel mixture ratio can be suppressed during the acceleration.

The effects provided in the first preferred embodiment can be listed as follows:

(1) The engine driveability is improved due to an appropriate acceleration correction irrespective of the engine operating condition before the acceleration.

In addition, since the deviation of the air-fuel mixture ratio from the three-catalytic point is less, the glitch of the emission characteristic becomes less and the exhaust clarification performance is improved.

(2) Since the engine driveability immediately after the engine start and the emission characteristic are improved, the engine stalling of the vehicle in which a power-assisted steering system is used can be prevented. Furthermore, the emission reduction and fuel consumption can be improved due to the steady leaning of the air-fuel mixture ratio.

(3) The similar effects described above can be achieved in a case where the fuel resumption is made immediately after the fuel cut-off. The prevention of hesitation and NOx reduction can also be achieved.

(4) The flat characteristic of the air-fuel mixture ratio at the time of the engine transient state can remarkably be improved.

(5) Since such an expensive component as the sensor for detecting the quantity of the wall current is not used, the software of the control unit 20 can be improved and the improvement of the table map data can be replaced in place of the specific wall current sensor. Consequently, the cost of installing the fuel injection controlling system can be saved.

SECOND PREFERRED EMBODIMENT

The configuration of the second preferred embodiment is substantially the same as that of the first preferred embodiment shown in FIG. 1.

Figure 12:
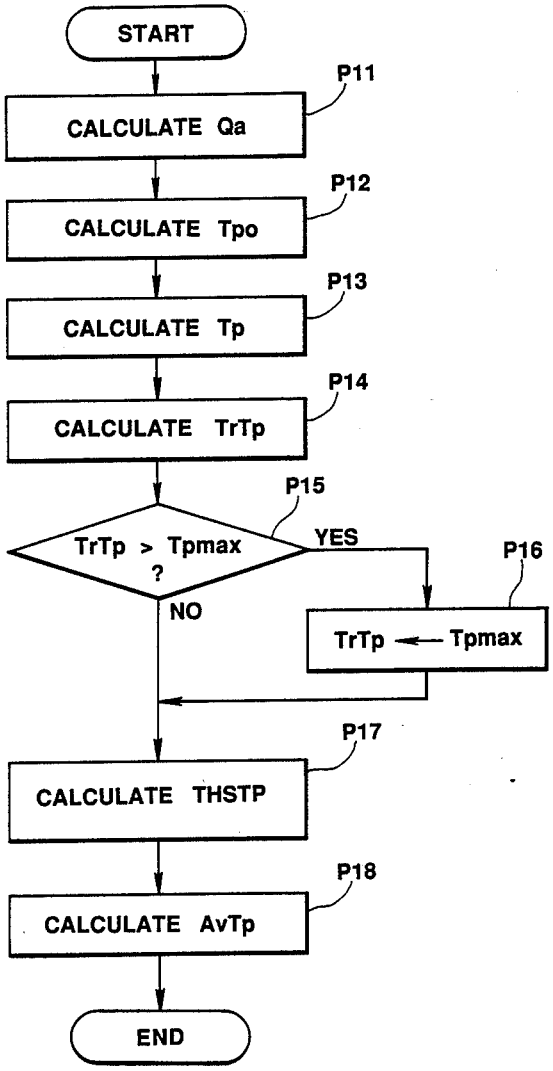
FIG. 12 is an operational flowchart for explaining a calculation of a smooth quantity of fuel Avtp in a second preferred embodiment according to the present invention.

FIG. 12 shows a program subroutine of deriving the smooth quantity of fuel Avtp.

In a step $P_{11}$, the CPU 21 reads the output signal of the airflow meter 7 in order to calculate the intake air quantity $Q_a$ through a table look up technique.

In a step $P_{12}$, the CPU 21 calculates a basic pulsewidth $T_{po}$ before the smoothing in accordance with the following equation (10).

$$T_{po}=Q_a/N\times K \quad (10)$$

In a step $P_{13}$, the CPU 21 calculates the basic pulsewidth $T_p$ from a weight mean of the $T_{po}$. This causes the ripple generated on the output signal of the airflow meter 7 to be smoothed.

In a step $P_{14}$, a flat correction basic pulsewidth TrTp is derived in accordance with the following equation (11).

$$TrTp=T_p\times Kflat \quad (11)$$

In the equation (11), Kflat denotes a flat A/F (air-fuel mixture ratio) correction coefficient and is derived from a table map on the basis of the engine revolutional speed N and $\alpha-N$ flow quantity of intake air Qho with the interpolation method.

It is noted that $\alpha-N$ flow quantity is derived on the basis of the opening angle TVO of the throttle valve 8 derived from the opening angle sensor 9 in place of the airflow meter 7 and the engine revolution speed N derived from the crank angle sensor 10.

The method of deriving Kflat is also exemplified by the Japanese Patent Application First Publication No. showa 63-38635 published on Feb. 19, 1988, the disclosure of which is hereby incorporated by reference.

In a step $P_{15}$, the value of TrTp is compared with a predetermined limit value $T_{pmax}$ which is longest of the pulsewidth.

If $TrTp\geqq T_{pmax}$ in the step $P_{15}$, the routine goes to a step $P_{16}$ in which the value of TrTp is set to $T_{pmax}$.

If $TrTp<T_{pmax}$ in the step $P_{15}$, the routine goes to a step $P_{17}$ in which a delay correction pulsewidth THSTP as an $\alpha-N$ anticipated correction pulsewidth is derived. In the step $P_{17}$, the CPU 21 derives a change rate of the value THSTP looked up from the table map based on the $\alpha-N$ flow quantity Qho with the interpolation calculation for each 10 ms.

If the change quantity of the looked-up value of THSTP is below a correction threshold level, THSTP=0. If the change quantity thereof is negative (deceleration), the CPU 21 derives THSTP by multiplying the above-described change quantity thereof by a predetermined deceleration correction percentage.

The term THSTP is a term for anticipating a change of the opening angle TVO of the throttle valve 8 and for correcting the quantity of injected fuel with good responsive characteristic.

In a step $P_{18}$, the smooth quantity of fuel Avtp (corresponds to the smooth quantity of intake air) is derived in accordance with the following equation (12).

$$Avtp=TrTp\times FLOAD+Avtp_{-1}\times(1-FLOAD)+THSTP \quad (12)$$

In the equation (12), symbol FLOAD denotes a weight mean coefficient and is given as FLOAD=TFLOAD+K2D (added in the case of only deceleration).

Since the value of TFLOAD is a function of only intake volume, TFLOAD is derived from an air flow quantity area AA and (displacement×revolutional speed) NVM through a table map. The air flow quantity area AA is exemplified by the Japanese Patent Application First Publication No. Showa 63-41634 published on Feb. 22, 1988, the disclosure of which is hereby incorporated by reference.

Hence, the right first and second terms of the above-described equation (12) are values derived from the weight mean using the value of FLOAD with respect to the flat correction basic pulsewidth TrTP calculated on the basis of the value corrected in terms of the ripples included in the output signal of the airflow meter 7. In other words, the values of the right first and second terms in the equation (12) correspond to the parts calculated from the first order lag of the TrTp. The right third term of the equation (12) is a part of anticipating and correcting the opening angle TVO of the throttle valve 8.

Figure 13:
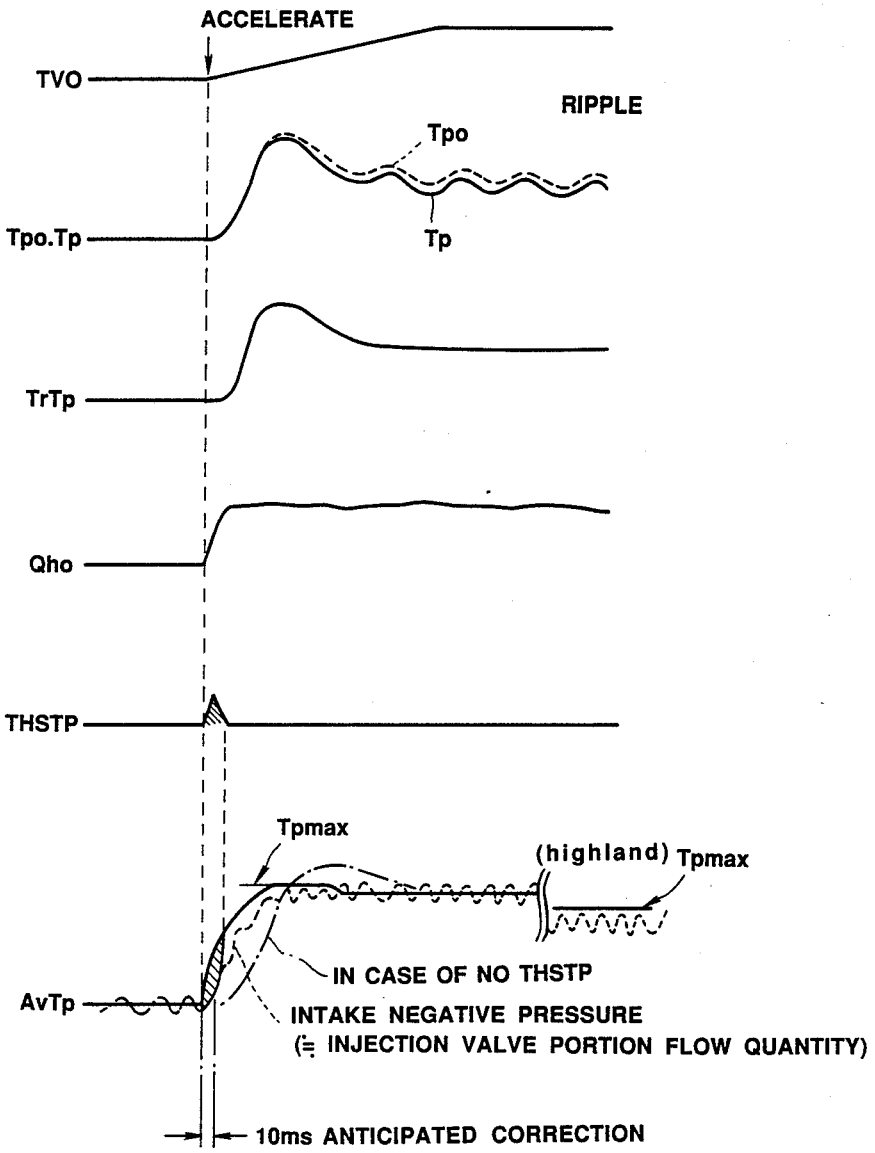
FIG. 13 is a timing chart for explaining an action based on the smooth quantity of fuel Avtp calculated in the second preferred embodiment.

The effect of adding THSTP in the Avtp of the right third term is shown in FIG. 13.

In FIG. 13, in a case where the engine 1 is accelerated at a timing shown in FIG. 13, each basic pulsewidth Tpo, Tp is changed at a timing relatively late with respect to a change motion of the opening angle TVO of the throttle valve 8.

A waveform which has corrected the flat corrected basic pulsewidth TrTp is changed as shown in FIG. 13 (as the flat correction basic pulsewidth TrTp).

On the other hand, the $\alpha-N$ flow quantity is changed in the step-wise according to the opening angle TVO of the throttle valve 8 and the delay correction pulsewidth THSTP is calculated according to the change quantity of the opening angle TVO.

In addition, the smooth quantity of injected fuel Avtp is derived in the first order lag of TrTp.

The conventional quantity of Avtp in a phase control without the addition of THSTP is changed as denoted by a dot-and-dash line of FIG. 13. As shown in FIG. 13, the dot-and-dash line indicates lack of responsive characteristic.

At this time, the intake negative pressure is denoted by a broken line and is substantially equal to the air quantity flowing about the fuel injection valve portion (fuel injector 4). However, the derived intake negative pressure cannot follow up the change in the opening angle TVO of the throttle valve 8 without delay. The intake air volume has an influence on the quantity of fuel adhered on the wall surface of the intake air passage 3.

On the other hand, the smooth quantity of injected fuel Avtp in the second preferred embodiment has extremely good responsive characteristic and substantially matches with an actual change in the air flow quantity since the correction term of THSTP is added as an anticipated correction on the $\alpha-N$ flow quantity (an anticipated correction for 10 ms). In FIG. 13, the example of Avtp when the vehicle runs on a highland is also shown.

Figure 14:
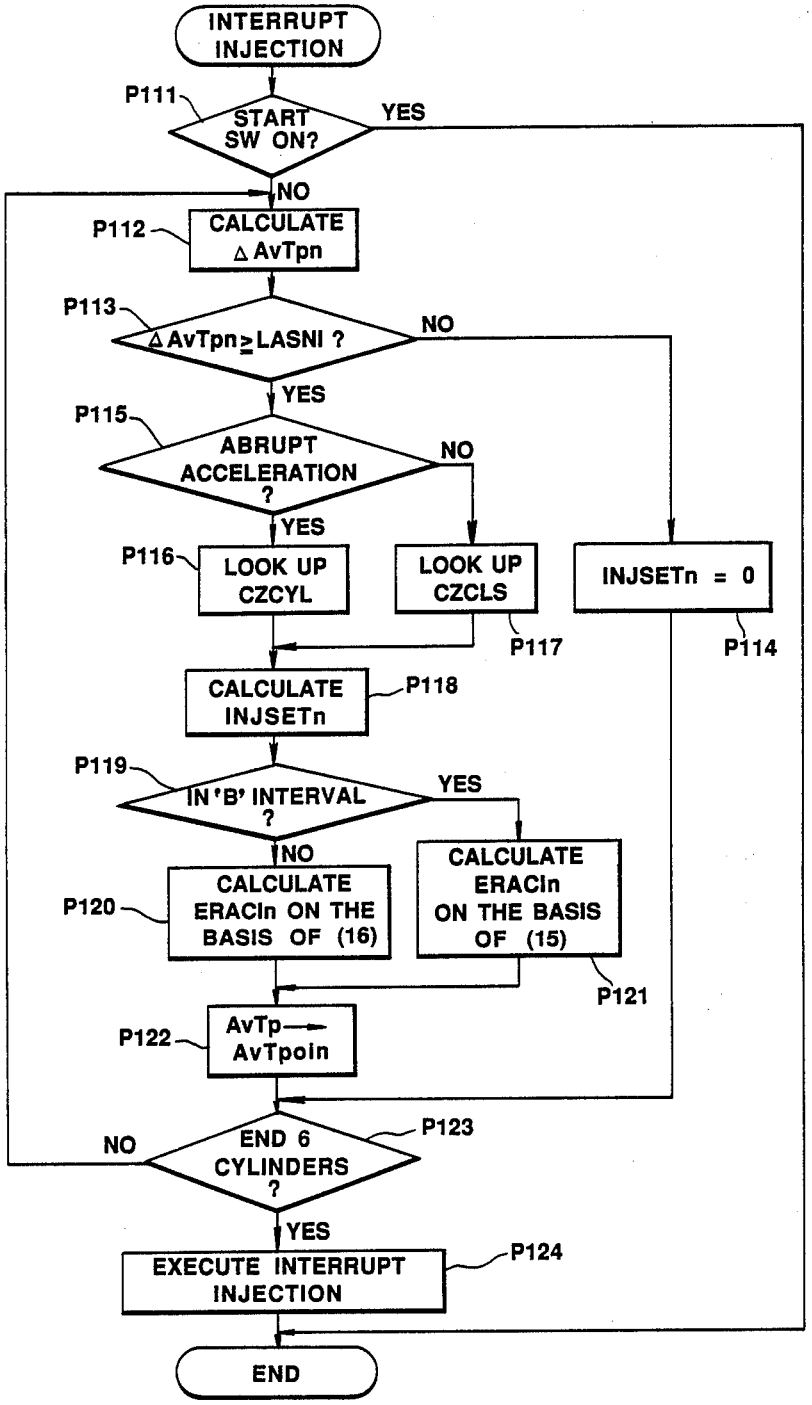
FIG. 14 is a flowchart for explaining a program of an interrupt fuel injection executed in the second preferred embodiment.

FIG. 14 shows a program flowchart executed for an interrupt (asynchronization) fuel injection. It is noted that the second preferred embodiment shown in FIG. 14 is applicable to a six-cylinder engine.

In a step $P_{111}$, the CPU 21 determines whether the start switch 13 is turned on. When the start switch 13 is turned on, the CPU 21 determines that the engine is being cranked and the present routine is ended.

On the other hand, when the start switch 13 is not turned on, the CPU 21 determines that the engine cranking is ended and the routine goes to a step $P_{112}$.

In the step $P_{112}$, the CPU 21 derives the change quantity of Avtp, i.e., ΔAvtpn (n denotes the cylinder number) in accordance with the following equation (13).

$$\Delta Avtpn = Avtpn - Avtpoin \quad (13)$$

In the equation (13), Avtpoin denotes a previous value of Avtp ($Avtp_{-1}$) and corresponds to the change rate of the engine load L in the n number of cylinder.

In the next step $P_{13}$, the change quantity ΔAvtp is compared with a determination value LANSI to determine to execute the interrupt fuel injection.

If $\Delta AvTp < LANSI$, the CPU 21 determines that no interrupt injection is needed and sets an interrupt quantity of injected fuel INJSETn (corresponds to the asynchronization injection pulsewidth for each cylinder) to "0" in a step $P_{114}$.

On the other hand, if $\Delta AvTp \geqq LANSI$, the CPU 21 determines that the interrupt fuel injection is needed and the routine goes to a step $P_{115}$ in which the CPU 21 determines whether the acceleration is abrupt.

The method of determining whether the acceleration is abrupt of not (slow) is exemplified by a Japanese Patent Application First Publication Showa 64-3245 published on Jan. 9, 1989, the disclosure of which is hereby incorporated by reference. That is to say, the CPU 21 determines whether $DQCYL < LGZCYL$ (DQCYL denotes a change quantity of cylinder air quantity QCYL per 10 ms. ($QCYL = Q_H \times K_2 + QCYL_{-1} \times (1-K_2)$) and LGZCYL denotes a table switching determination level).

If the CPU 21 determines that the acceleration is abrupt in the step $P_{115}$, the routine goes to a step $P_{116}$ in which the CPU 21 looks up a correction coefficient CZCYL based on the timing of the asynchronization fuel injection from an abrupt acceleration table map.

If not abrupt acceleration, the routine goes to a step $P_{117}$ in which the CPU 21 looks up the correction coefficient GZCLS for the asynchronization fuel injection timing from a slow acceleration table map.

The coefficients GZCYL and GZCLS are used to correct the quantity of fuel injected at a timing of the asynchronization fuel injection. (For GZCYL and GZCLS, refer to the Japanese Patent Application First Publication No. Showa 64-3245.)

Next, the quantity of fuel INJSETn injected at the asynchronization fuel injection for each cylinder is calculated in accordance with the following equation (14) in a step $P_{118}$.

$$INJSETn = \Delta Avtpn \times GZT_w \times GZCYn + T_s \quad (14)$$

Figure 15:
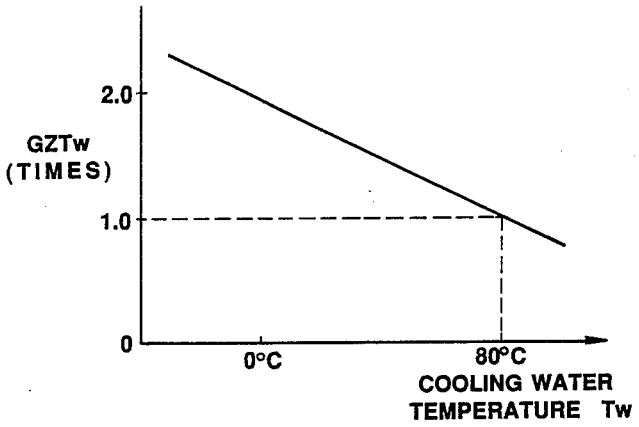
FIG. 15 is a characteristic graph for explaining a characteristic of a coolant temperature correction percentage GTZw (multiplying factor).
Figure 16:
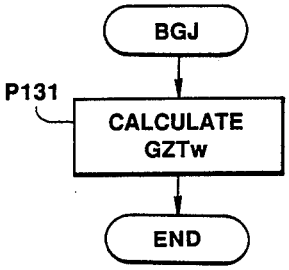
FIG. 16 is an operational flowchart for explaining a subroutine of looking up a correction percentage GTZw of a coolant temperature Tw shown in FIG. 15.

In the equation (14), GZTw denotes a coolant temperature correction coefficient for the asynchronization fuel injection for each cylinder and is derived in a step $P_{131}$ of a background job shown in FIG. 16 through a table look up using a characteristic graph with the coolant temperature Tw as a parameter shown in FIG. 15. In addition, GZCYn in the equation (14) totally represents the correction coefficients GZCYL and GZCLS for the fuel injection timings and $T_s$ denotes a correction coefficient of a dead time provided for each fuel injector 4.

In a step $P_{119}$, the CPU 21 determines whether the timing of the present asynchronization fuel injection falls in an timing interval from the previous synchronization fuel injection to the suction stroke (hereinafter, this timing interval is referred to as a B interval). It is noted that when the timing of the asynchronization fuel injection falls in a timing interval from the suction stroke to the present synchronization fuel injection, such a timing interval is expressed as an A interval. The CPU 21 reads the present crank angle from the crank angle sensor 10 to determines the present synchronization fuel injection timing.

Figure 18:
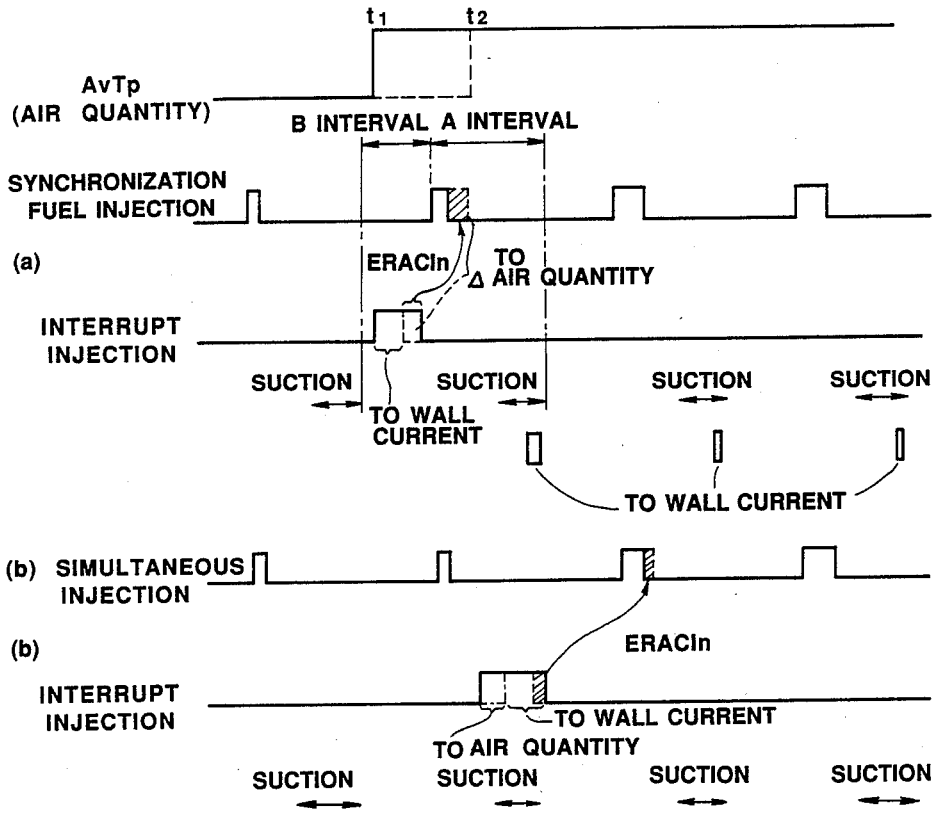
FIG. 18 is a timing chart for explaining an action and contents of an interrupt (asynchronization) fuel injection executed in the second preferred embodiment according to the present invention.

The A and B intervals are shown in FIG. 18.

The determination of the asynchronization fuel injection timing may be carried out by, e.g., checking whether in the present crank angle, ERACIn is set to 0 in a step $P_{143}$ of FIG. 17, as will be described later, since the A time interval indicates the end of the synchronization fuel injection.

When the timing of the asynchronization fuel injection falls in the B interval, i.e., YES in the step $P_{119}$, the routine goes to a step $P_{121}$ in which the CPU 21 calculates a correction quantity ERACIn (a pulsewidth when the asynchronization fuel injection is transferred and corresponds to a correction quantity for the transfer to the synchronization fuel injection) in accordance with the following equation (15).

$$ERACIn = \Delta Avtpn \times GZTw \times (GZCYn - ERACPH) + ERACIn' \quad (15)$$

In the equation (15), ERACIn' denotes a previous value of ERACIn and is stored in the RAM 23.

In addition, ERACPH denotes a basic correction factor along with the transfer to the asynchronization fuel injection and a factor for compensating for the wall current. Hence, e.g., if GZCYn is larger than ERACPH, ERACIn indicates positive and the subsequent synchronization fuel injection quantity is decreased by means of ERACIn with a factor of the difference between GZCYn and ERACPH. This is because the next synchronization fuel injection is sufficient for the increase in the air quantity corresponding to the increase in the load and this is directed for the correction only for the wall current. It is noted that ERACIn' corresponds to a wall current correction changing with a relatively high-speed time constant, so-called, high-frequency wall current.

On the other hand, if the timing of the asynchronization fuel injection falls in the A interval (No) in the step $P_{119}$, the routine goes to a step $P_{120}$ in which the incremental correction quantity ERACIn is calculated in accordance with the following equation (16).

$$ERACIn = \Delta AvTpn \times GZTw \times (GZCYn - ERACP) + ERACIn' \quad (16)$$

In the equation (16), ERACP denotes a basic correction coefficient of the asynchronization fuel injection transfer to which the increase of the air quantity is added in addition to the wall current increment. It is noted that ERACP is larger than ERACPH since it is not necessary to decrease the subsequent synchronization fuel injection (subsequent and subsequent quantity corresponding to intake air) although the incremented quantity of intake air is compensated at the fuel injection of the synchronization fuel injection and since the increment of the air quantity is needed to be compensated when the subsequent synchronization fuel injection at the suction stroke is ended.

ERACP in the equation (16) denotes the basic correction coefficient for the transfer to the asynchronization fuel injection in the same way as ERACPH. In this case, since the incremented quantity of fuel corresponding to the intake air quantity is needed to be included in the interrupt fuel injection, a total increment quantity of the interrupt fuel injection and synchronization fuel injection has the following relationship: total incremented quantity = wall current + incremented quantity of air = ERACP × GZTw × ΔAvtp In a step $P_{122}$, the CPU 21 sets the present Avtp to an old value Avtpoin. In a step $P_{123}$, the CPU 21 determines whether the calculation of Avtp is ended for all cylinders, i.e., six cylinders. If not ended in the step $P_{123}$, the routine returns to the step $P_{112}$. If ended, the routine goes to a step $P_{124}$ in which the CPU 21 sets the interrupt fuel injection quantity INJSETn to the Output Port 24 to execute the interrupt fuel injection for the corresponding cylinder.

Figure 17:
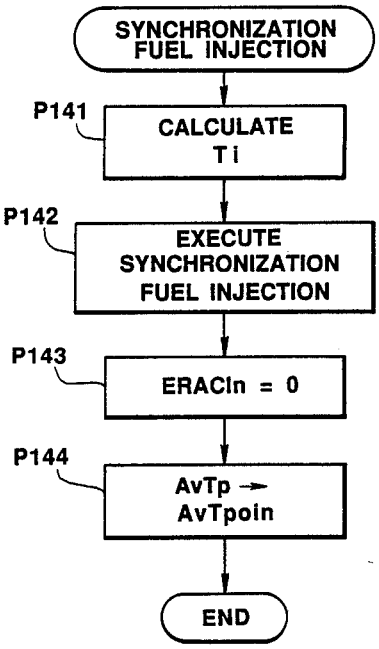
FIG. 17 is an operational flowchart for explaining a program of synchronization fuel injection executed in the second preferred embodiment according to the present invention.

FIG. 17 shows a program flowchart for executing the synchronization fuel injection.

The program flowchart shown in FIG. 17 is executed for each engine revolution.

In a step $P_{141}$, the quantity of fuel $T_i$ injected in synchronization with the engine revolution is calculated in accordance with the following equation (17).

$$T_i = (AvTp \times \alpha m + Kathos) \times \alpha + T_s + (Chosn - ERACIn) \quad (17)$$

In the equation (17), Kathos denotes a correction quantity for correcting the fuel quantity according to the wall current and is changed with a relatively slow time constant (so-called, low frequency quantity of adhered fuel). Kathos is a function of the adhered speed of fuel onto the adhered portion, i.e., Vmf [ms.] and correction factor Ghf [%] as described in the first preferred embodiment.

$\alpha$ denotes a correction coefficient of $\lambda$ control of the air-fuel mixture ratio on the basis of the output of the oxygen sensor 12 and $\alpha m$ denotes a correction coefficient of the learning control of the air-fuel mixture ratio. In addition, symbol Chosn denotes a correction quantity of the wall current for each cylinder. That is to say, $$Chosn = \Delta Avtpn \times GZTwP \text{ (or GZTwM)} \quad (18)$$

In the equation (18), GZTwP denotes a correction coefficient of the coolant temperature Tw during the acceleration and GZTwM denotes the correction coefficient during the deceleration.

In a step $P_{142}$, the CPU 21 sets the synchronization fuel injection quantity denoted by Ti to the Output Port 24 to execute the synchronization fuel injection.

Thereafter, the routine goes to the step $P_{143}$ in which ERACIn = 0. In a step $P_{144}$, the CPU 21 sets the present Avtp to an old value of Avtpoin and the routine is ended.

FIG. 18 shows a timing chart for explaining an actual fuel injection condition as the result of the execution of each program shown in FIGS. 14 to 17.

In cases where the engine load (air quantity and corresponds to ΔAvtp) is changed at a timing $t_1$ and at a timing $t_2$, the interrupt fuel injection is carried out in the B interval and the interrupt fuel injection is carried out in the A interval, respectively.

Interrupt fuel injection in the B interval ((a) of FIG. 18).

Since the quantity of fuel at the present interrupt fuel injection corresponding to the change in the air quantity along with the increase in the load is included into the quantity Avtp at the subsequent synchronization fuel injection, the quantity of the present interrupt fuel injection may be based on the quantity of fuel corresponding to the wall current.

The quantity of injected fuel INJSETn is calculated in accordance with the equation (14) described above.

Figure 19:
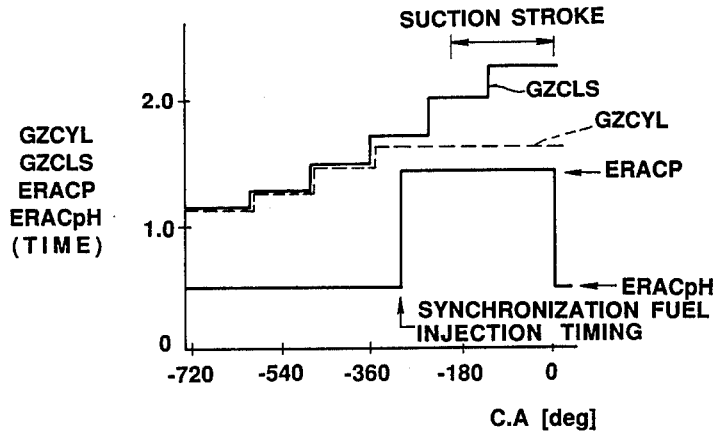
FIG. 19 is a characteristic graph representing various types of correction quantities GZCYL, GZCLS, ERACP, and ERASPH of fuel used in the second preferred embodiment.

The relationship between the correction coefficients of the fuel injection timings CZCYL and CZCLS and fuel injection timings is shown in FIG. 19.

For example, when CZCYn of the interrupt fuel injection is larger than ERACPH, the synchronization fuel injection is decreased by ERACIn as is deemed as an over-injection. The synchronization fuel injection is executed by means of the program shown in FIG. 17.

Hence, a hatched portion shown in (a) of FIG. 18 in the case of the synchronization fuel injection is decreased as the incremented correction quantity ERACIn.

It is noted that the quantity of fuel corresponding to the wall current is sequentially reduced for each subsequent suction stroke as shown in (a) of FIG. 18. Hence, if GZCYn determined according to the timing at which the interrupt fuel injection is carried out includes the quantity of fuel incremented according to the air quantity, the value of GZCYn becomes larger than ERACPH and the quantity of fuel incremented according to the increase in the air quantity is decreased as the subsequent synchronization fuel injection is carried out.

In a case where the timing at which the synchronization fuel injection is carried out is immediate before the suction stroke, only a small rate of the synchronization fuel injection quantity is sucked into the corresponding cylinder. Therefore, the fuel quantity corresponding to the increase of air quantity may earlier be injected during the interrupt injection of fuel to prevent the subsequent lean of the air-fuel mixture ratio and to prevent the leaned air-fuel mixture ratio at the time of the subsequent and subsequent suction stroke.

In a case where the timing at which the fuel synchronization injection occurs is sufficiently before the suction stroke, it is not necessary to inject the quantity of fuel corresponding to the increase in the air quantity at the interrupt fuel injection.

In either case, ERACPH (multiplying factor)×GTZTW (multiplying factor) denote a total correction multiplying factor of combining the fuel interrupt injection quantity with the subsequent quantity of decrease.

Interrupt fuel injection at A interval (refer to (b) of FIG. 18).

At this time, the rate of change in the air quantity as the result of increase in the load is added together during the present interrupt fuel injection.

That is to say, the quantity of fuel corresponding to the increase in the air quantity after the previous synchronization fuel injection is executed is reflected into the interrupt quantity of fuel. The ERACIn, in this case, is calculated in accordance with the above-described equation (16).

The ERACIn is calculated on the basis of ERACP whose value is larger than ERACPH by the quantity of fuel corresponding to the increase in the air quantity.

Hence, the reduced quantity ERACIn at the time of the subsequent synchronization serves to reduce only the quantity of fuel by which the wall current is excessively increased due to the fuel interrupt injection. Therefore, the fuel injection pulsewidth at the time of the subsequent synchronization fuel injection is calculated so as to be reduced by a hatched portion shown in (b) of FIG. 18.

That is to say, the subsequent synchronization fuel injection quantity is reduced and corrected. Hence, no problem of becoming insufficient quantity of fuel at the asynchronization fuel injection occurs.

In addition, since the synchronization quantity of fuel is appropriately reduced, the air-fuel mixture ratio becomes an optimum state for each cylinder and the flat characteristic of the air-fuel mixture ratio can be assured.

It is noted that the following equation (19) may be replaced with the equations (15) and (16) executed in the steps $P_{121}$ and $P_{120}$ to calculate ERACIn.

$$\mathrm{ERACIn} = \Delta\mathrm{Avtp} \times \mathrm{GZTw} \times (GZCYn - ERACPH) - \Delta Avtp + ERACIn' \quad (19)$$

Although the term of Avtp in the equation (19) is reduced as the quantity of fuel corresponding to the change rate of air quantity, this is limited to the case shown in (b) of FIG. 18. In the case of (a) of FIG. 18, such a calculation as $-\Delta$Avtp is not needed.

In the second preferred embodiment, the correction of fuel injection quantity is precisely carried out for each engine cylinder according to the timing of the asynchronization fuel injection.

The rich and/or lean air-fuel mixture ratio for each engine cylinder is not generated and the flat characteristic of the air-fuel mixture ratio can be assured to prevent the glitch in the exhaust gas emission characteristic. Consequently, the conversion efficiency of the CCRO can be enhanced.

THIRD PREFERRED EMBODIMENT

The configuration of the third preferred embodiment of the fuel injection controlling system is substantially the same as shown in FIG. 1.

It is noted that the crank angle sensor 10 outputs a reference signal Ca having a high level [H], e.g., when each piston of the cylinders reaches, a predetermined position before a top dead center (TDC), e.g., BTDC 70° in a compression stroke whenever an explosion stroke occurs (in a case of a six cylinder engine, 120°, and in a case of a four cylinder engine, 180°) and outputs a unit angle pulse $C_1$ of the crank angle (,e.g., 2°) whenever the engine crankshaft rotates through the unit angle. The engine revolutional speed N is detected by counting the number of the reference signals Ca per unit time.

In the third preferred embodiment, the smooth quantity of fuel Avtp is derived using the program flowchart shown in FIG. 12. The explanation of FIG. 12 is already described in the second preferred embodiment.

The effect of adding the THSTP in the right third term of the equation (12) is already shown in FIG. 13.

Figure 20:
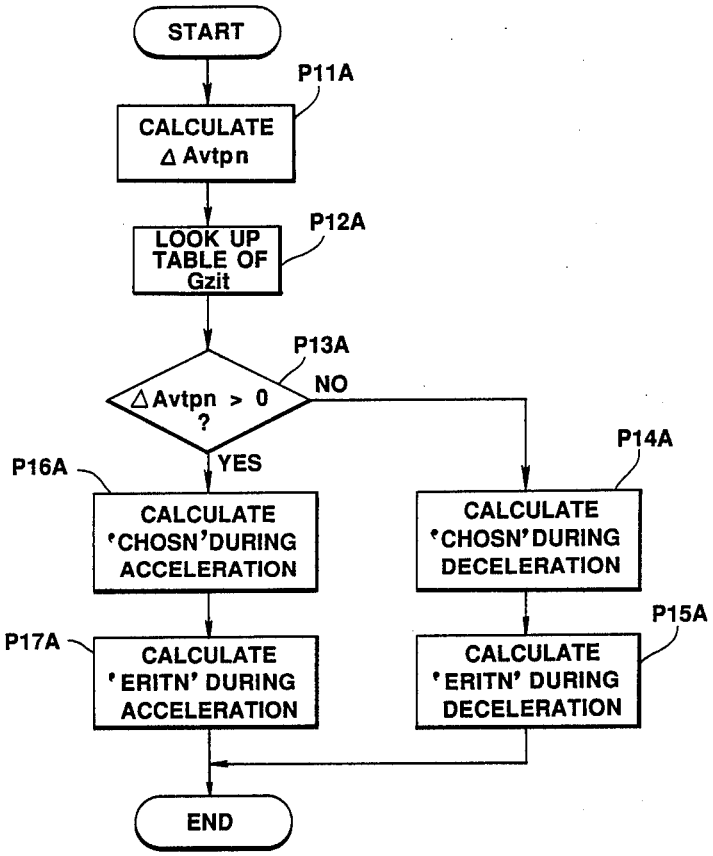
FIG. 20 is an operational flowchart for explaining calculations of correction quantities Chson and Eritn for each engine cylinder executed in a third preferred embodiment according to the present invention.

FIG. 20 shows a program flowchart for calculating the wall-current correction quantity for each cylinder (transient state correction quantity) Chosn.

The program flowchart shown in FIG. 20 is executed for each predetermined time.

In a step $P_{11A}$, the CPU 21 calculates a change quantity $\Delta$Avtpn (n: cylinder number) of the smooth quantity of injected fuel Avtp (corresponds to the smooth intake air quantity) in accordance with the following equation (20).

The term $\Delta$Avtp corresponds to the change quantity of the engine load.

$$\Delta Avtpn = Avtp - Avtpoin \quad (20)$$

Avtpoin denotes a value ($\mathrm{Avtp}_{-1}$) of the smooth quantity at a time when the fuel is previously injected and corresponds to n number of cylinder.

In a step $P_{12A}$, the CPU 21 looks up the correction percentage for the fuel injection timing Gzit from a table map having a parameter of the fuel injection timing T. It is noted that the fuel injection timing T is derived from the crank angle signal $C_1$ and reference signal $C_a$ of the crank angle sensor 10 when the CPU 21 executes a step $P_{23}$ of FIG. 21 as will be described later. The Gzit (times) is used to correct the results of calculations of the wall current correction quantity Chosn as will be described later and incremented correction quantity for each cylinder Eracin in terms of the fuel injection timing. The value of Gzit may be derived from a predetermined table map with the crank angular position derived from the crank angle sensor 10 as a parameter. The value of Gtz is such that as the fuel injection timing comes nearer to the suction stroke of each cylinder, the value becomes increased to compensate for the quantity of fuel vaporized and brought away from the wall surface into the combustion chamber. In a step $P_{13A}$, the CPU 21 determines whether AvTp>0. That is to say, the sign of Avtp is determined to detect whether the engine 1 is accelerated or decelerated. If Avtp<0, the CPU 21 determines that the engine 1 is decelerated and the routine goes to a step $P_{14A}$. In the step $P_{14A}$, the CPU 21 calculates the wall current correction quantity for each cylinder Chosn in the deceleration state in accordance with the following equation (21).

$$Chosn = Avtpn \times Gztwn \times Gzit \quad (21)$$

In the equation, Gztwn: coolant water correction coefficient at the time of deceleration.

In a step $P_{15A}$, the CPU 21 derives the incremented quantity correction quantity (over-insufficient correction quantity) for each cylinder Eritn and the present routine is ended.

$$Eritn = Avtpn \times Gztwn \times (Gzit - ERACPH) \quad (22)$$

In the equation (22), ERACPH: basic coefficient of the wall current high-frequency correction quantity described in the second preferred embodiment.

On the other hand, if Avtpn>0 in the step $P_{13A}$, the CPU 21 determines that the engine 1 is accelerated and the routine goes to a step $P_{16A}$.

In the step $P_{16A}$, the CPU 21 calculates the incremented correction quantity (transient state correction quantity) at the time of acceleration in accordance with the following equation (23).

$$Chosn = \Delta Avtpn \times Gztwp \times (Gzit - ERACPH) \quad (23)$$

In the equation (23), Gztwp denotes a coolant temperature correction coefficient.

In a step $P_{17A}$, the CPU 21 calculates the incremented correction quantity Eritn (over-insufficient correction quantity) for each cylinder during the acceleration and the present routine is ended.

$$Eritn = AvTpn \times Gztwp \times (Gzit - ERACPH) \quad (24)$$

The value of Gztwp may be the same as Gztw as will be described later. In addition, when the slight rich air-fuel mixture ratio is desired during the abrupt acceleration by means of the interrupt fuel injection, another table may be used (since in the case where a high-octane gasoline is used as the fuel, the slight rich air-fuel mixture ratio is desired).

Figure 21:
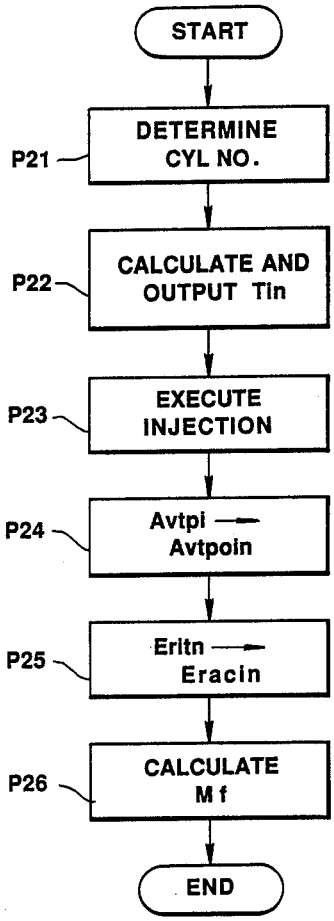
FIG. 21 is an operational flowchart for explaining a synchronization fuel injection executed in the third preferred embodiment.
Figure 22A:
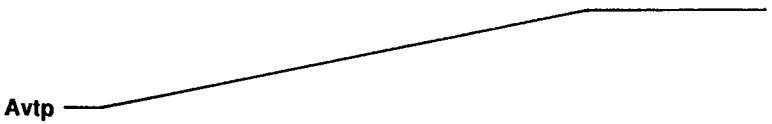
FIGS. 22 (A) to 22 (D) are timing charts for explaining a synchronization fuel injection pulsewidth in the third preferred embodiment.
Figure 22B:
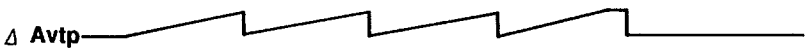
Figure 22C:
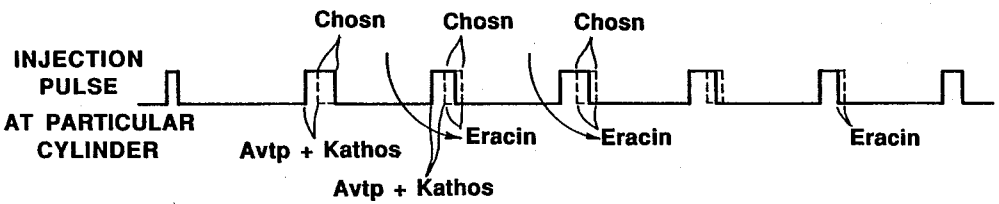
Figure 22D:
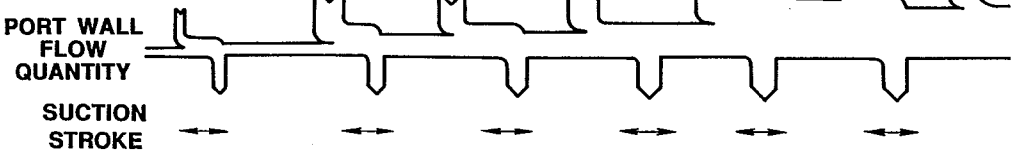

FIG. 21 shows a program flowchart for executing the synchronization fuel injection in the third preferred embodiment.

The program flowchart shown in FIG. 21 is executed in synchronization with the engine revolutions.

In a step $P_{21}$, the CPU 21 determines the cylinder number n toward which the fuel is injected. The cylinder number n is identified by reading the cylinder number identification signal outputted from the crank angle sensor 10.

In a step $P_{22}$, the synchronization fuel injection quantity $T_{in}$ according to the cylinder is calculated in accordance with the following equation (25) and the fuel injection signal Si is outputted to the fuel injector 4 via the I/O Port 24.

$$Tin = (Avtp + Kathos) \times Tfbya \times (\alpha + \alpha m) + Chson - old\ Eracin + Ts \quad (25)$$

Kathos (transient state correction quantity): the wall current correction percentage (low-frequency component) which changes with relatively slow time constant.

In the equation (25), Tfbya: target (stoichiometric air-fuel mixture ratio) air-fuel mixture ratio (the method of deriving Tfbya is exemplified by a Japanese Patent Application First Publication No. showa 63-38635 published on Feb. 19, 1988, the disclosure of which is hereby incorporated by reference);

$\alpha$: control correction coefficient of the air-fuel mixture ratio based on the output of the oxygen sensor 12;

$\alpha m$: correction coefficient of the air-fuel mixture ratio learning control; and, Old Earsin=ERACIn' in the equation (16).

In a step $P_{23}$, the fuel injector 4 is driven to inject fuel according to the injection pulsewidth Ti in response to the fuel injection signal Si. Next, in a step $P_{24}$, the present smooth fuel injection quantity Avtpi used in the equation (24) is stored in the RAM 23 as the previous smooth fuel injection quantity Avtpoin (Avtpi→Avtpoin). In a step $P_{25}$, the incremented correction quantity of fuel Eritin for each cylinder derived in the step $P_{15A}$ or $P_{17A}$ is stored in the RAM 23 as Eracin for calculating the subsequent synchronization fuel injection quantity Tin.

Next, in a step $P_{26}$, the wall current quantity Mf is calculated in accordance with the following equation (26) and its value is stored into the RAM 23 to end the present routine.

$$Mf = old\ Mf + Vmf \quad (26)$$

In the equation (26), old Mf: a previous wall current calculated value and Vmf: injected fuel adhered speed described above.

FIGS. 22 (A) through 22 (D) show a timing chart explaining an actual operation of the fuel injection as the result of executions in the programs in the third preferred embodiment when the engine 1 is slowly decelerated.

As shown in FIG. 22 (C), a first synchronization fuel injection quantity Ti immediately after the engine 1 is transferred into the slow acceleration state is corrected so as to increase the quantity of fuel by the wall current correction quantity for each cylinder Chosn and the next Tin is corrected in which the incremented quantity of fuel by Chosn is corrected by the incremented correction quantity for each cylinder Erasin. Thereafter, since the quantity of fuel brought into the combustion chamber together with the increase in the wall current quantity is increased at the suction stroke, the correction quantity is accordingly decreased.

Figure 23:
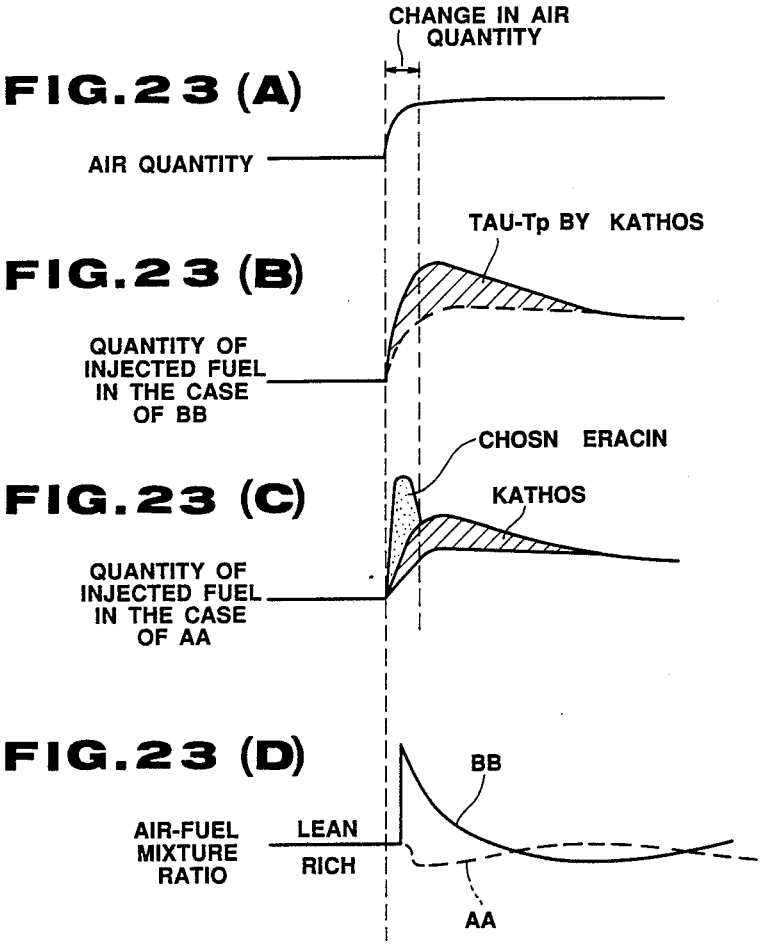
FIGS. 23 (A) to 23 (D) are timing charts for explaining the action of the synchronization fuel injection during a change in an engine load in the third preferred embodiment according to the present invention.

FIGS. 23 (A) through 23 (D) show the behaviors of the air quantity, fuel injection quantity, and air-fuel mixture ratio in the third preferred embodiment and in the previously proposed fuel injection controlling system.

When a step-wise change in the air quantity occurs as shown in FIG. 23 (A), the previously proposed fuel controlling system corrects the executed duration of fuel injection TAU-Tp by the wall current correction quantity Kathos as shown in FIG. 23 (B). The fuel injection time TAU-Tp is exemplified by a Japanese Patent Application First Publication No. showa 58-8238 published on Jan. 18, 1983, the disclosure of which is hereby incorporated by reference.

Therefore, the fuel injection quantity is corrected as denoted by a hatched portion in FIG. 23 (B) so that a control lag occurs with respect to a peak value of the air quantity. In addition, the quantity of fuel which becomes the wall current is increased so that the air-fuel mixture ratio becomes deviated toward the lean side as denoted by AAA in FIG. 23 (D).

On the other hand, since, in the third preferred embodiment, the quantity of injected fuel immediately after the change in the air quantity occurs is corrected by Kathos, the wall current correction quantity Chosn for each cylinder corrected by the fuel injection timing correction percentage Gzit described above, and the incremented correction quantity Erasin for each cylinder, the control responsive characteristic is improved.

In addition, the quantity of injected fuel is incremented in harmony with the transfer of the change in intake air quantity to the peak value and the air-fuel mixture ratio is not deviated toward the lean side.

Consequently, as denoted by a broken line of BB in FIG. 23 (D), the variation of the air-fuel mixture ratio at the time of transient operating state becomes slight and flat. Thus, the exhaust gas emission characteristic can be improved.

In the case of the engine deceleration; the synchronization fuel injection quantity immediately after the deceleration state is transferred is decreased according to the change in the air quantity. After the quantity of fuel is decreased, the fuel injection quantity is incremented to prevent the lean air-fuel mixture after the correction of decreasing the fuel injection quantity. Thus, the same effect as that in the case of acceleration can be achieved.

In the third preferred embodiment, the synchronization fuel injection has been described. However, the same effect can be achieved when the interrupt quantity of injected fuel INJSETn and incremented correction quantity for each cylinder Erasin are calculated in accordance with the following equations (27) and (28).

$$INJSETn = \Delta Avtpoin \times Gztw \times Gzcyn + Ts \quad (27)$$

ΔAvtpoin: previous value of ΔAvtpn.

Gztw: coolant temperature correction percentage of the asynchronization fuel injection for each cylinder.

$$Erasin = Erasin' + \Delta Avtpoin \times Gztw \times (Gzcyn - Eracp) \quad (28)$$

Eracin': previous Erasin.

Eracp: reference correction percentage transferred to the asynchronization fuel injection.

When using the equations (27) and (28), the flat characteristic of the air-fuel mixture ratio during the asynchronization fuel injection can be achieved.

As described hereinabove, in the first preferred embodiment of the fuel injection controlling system according to the present invention, the temperature of the fuel-adhered wall portion is appropriately predicted to accurately determine the fuel quantity flowing as the wall current so that the transient state correction quantity of injected fuel is appropriately corrected when the engine 1 falls in a transient state and the air-fuel mixture ratio becomes flat at the transient operating state.

In the second preferred embodiment, the correction quantity is changed which is used during the subsequent synchronization fuel injection depending on whether the interrupt fuel injection carried out during the abrupt acceleration is earlier or later than the synchronization fuel injection corresponding to the subsequent suction stroke.

In the third preferred embodiment, the quantity of injected fuel during the synchronization fuel injection is corrected by other appropriate correction coefficients which are derived according to the start timing of the synchronization fuel injection in addition to the transient state correction quantity.

Consequently, the deviation of the air-fuel mixture ratio during the transient state from the target air-fuel mixture ratio is suppressed at minimum to improve the engine driveability. In addition, the exhaust gas emission characteristic can be improved.

It will fully be appreciated by those skilled in the art that the foregoing description is made in terms of the preferred embodiments and various changes and modifications may be made without departing from the scope of the present invention which is to be defined by the appended claims.

What is claimed is:

1. A system for controlling fuel supply quantity for an internal combustion engine, comprising:

(a) first means for detecting parameters determining an engine operating condition;

(b) second means for determining whether the engine falls in a transient operating state on the basis of the detected parameters;

(c) third means for deriving a quantity of fuel to be supplied to each engine cylinder on the basis of the detected parameters;

(d) fourth means for deriving a characteristic having a correlation to part of the quantity of fuel which has been supplied toward a wall surface of an engine intake air passage, has been adhered onto the wall surface, and will be brought into a combustion chamber of each engine cylinder during its suction stroke at the present fuel supply timing on the basis of the detected parameters;

(e) fifth means for deriving a correction quantity for the quantity of fuel derived by the third means on the basis of the characteristic derived by the fourth means when the engine falls in the transient operating condition; and (f) sixth means for supplying the quantity of fuel for each cylinder which is derived by the third means and corrected by the fifth means.

2. A system as set forth in claim 1, wherein the fourth means includes: (a) seventh means for deriving an equilibrium state temperature at the wall surface on the basis of the detected operating condition parameters; (b) eighth means for deriving a delay time constant of the temperature at the wall surface; (c) ninth means for deriving an instantaneous temperature of the wall surface and deriving a predicted value of the temperature on the basis of the derived equilibrium state temperature and delay time constant; and (d) tenth means for deriving an intake air temperature.

3. A system as set forth in claim 2, wherein the seventh means derives the equilibrium state temperature Tho on the basis of the instantaneous intake air quantity Qcyl and instantaneous engine revolutional speed N.

4. A system as set forth in claim 3, wherein the ninth means derives the instantaneous temperature Th at the wall surface using the following equation (1):

$$Th = Tho - (80 - Tw) \times C_1 - (25 - Ta) \times C_2 \quad (1),$$

wherein $C_1$, $C_2$: constants, Tw: coolant temperature derived by the first means, Ta: intake air temperature derived by the first means.

5. A system as set forth in claim 4, wherein the eighth means derives the delay time constant SPTF corresponding to a change speed of the temperature Th on the basis of Qcyl and N.

6. A system as set forth in claim 5, wherein the ninth means derives a predicted value Tf of the temperature at the wall surface from the following equation (2):

$$Tf = Th \times SPTF + T_{f-1} \times (1 - SPTF) \quad (2),$$

wherein $T_{f-1}$ denotes a previous value of Tf.

7. A system as set forth in claim 6, wherein the first means includes an airflow meter for detecting an intake air quantity and wherein the fifth means comprises:

(a) eleventh means for deriving an equilibrium state quantity Mfh of fuel adhered on the wall surface using the following equation (3):

$$Mfh = Avtp \times Mfhtvo + A \quad (3),$$

wherein Avtp denotes a smooth quantity of injected fuel which is derived by smoothing an output of the airflow meter with a first-order lag and is calculated as the quantity of fuel injected on the basis of the smoothed quantity of intake air and Mfhtvo denotes a multiplying factor of the quantity of fuel adhered onto the wall surface and is derived by engine load L and N and A denotes a correction value based on the predicted value of the temperature; (b) twelfth means for deriving a divided rate Kmf using the following equation (4):

$$Kmfat \times Kmfn + A \quad (4),$$

wherein Kmfat denotes a basic rate of divided quantity of fuel and is derived from a table map using $\alpha - N$ flow quantity Qho (an intake quantity derived from an opening angle of an engine throttle valve Tvo and engine revolutional speed N) and coolant temperature Tw in an interpolation method and Kmfn denotes a correction percentage of the engine revolution of the rate of divided quantity and is derived from a table map in the interpolation method; (c) thirteenth means for deriving a speed of the adhered fuel quantity Vmf using the following equation (5):

$$Vmf = (Mfh - Mf) \times Kmf \quad (5),$$

wherein $$Mf = (Mf - 1\ \text{ref}) + Vmf \quad (6),$$

wherein (Mf − 1 ref) denotes a quantity of fuel adhered on the wall surface at the time of a previous injection of fuel through the sixth means and Vmf denotes a flow quantity of fuel occupied as the current flowing toward the wall surface per revolution; (d) fourteenth means for deriving a correction percentage Ghf using the following equation (7):

$$Ghf = Ghfgen \times KtgKL \quad (7),$$

wherein Ghfgen denotes a reduction percentage of injected fuel, is derived as 0 when $Vmf \geqq 0$, and uses either of a load term of the correction percentage Ghfg or Ghfn which is larger than the other, and wherein Ghfgen is derived through a table look-up technique on the basis of a smooth quantity of injected fuel Avtp and KtgKL denotes a transient learning low-frequency coefficient; (e) fifteenth means for deriving the transient state correction quantity Kathos using the following equation (8):

$$Kathos = Vmf \times Ghf \quad (8).$$

8. A system as set forth in claim 7, wherein the sixth means supplies the quantity of fuel derived in the following equation (9):

$$Ti = (Tp \times \alpha m + Kathos) \times \alpha + Ts \quad (9),$$

wherein Tp denotes a basic quantity of injected fuel derived on the basis of the engine load L and engine revolutional speed N, $\alpha$ denotes a $\lambda$ (ramda) control correction coefficient of the air-fuel mixture ratio based on an output of an oxygen sensor constituting the first means, $\alpha m$ denotes a correction coefficient of a learning control of the air-fuel mixture ratio, and Ts denotes a correction coefficient of a dead time of one fuel injector constituting the sixth means.

9. A system as set forth in claim 1, which further comprises seventh means for deriving a change rate of an engine load on the basis of one of the detected parameters and determining whether an asynchronization injection of fuel which is executed independently of a synchronization injection of fuel executed in synchronization with an engine revolution.

10. A system as set forth in claim 9, wherein the fourth means derives a timing at which the asynchronization fuel injection is carried out when the seventh means determines the execution of the asynchronization fuel injection and determines whether the timing of the asynchronization fuel injection is earlier or later than the synchronization fuel injection corresponding to the subsequent suction stroke.

11. A system as set forth in claim 10, wherein the third means comprises: (a) eighth means for deriving the quantity of fuel injected at the synchronization fuel injection on the basis of the detected parameters; and (b) ninth means for deriving the quantity of fuel injected for each cylinder at the asynchronization fuel injection on the basis of the change rate of the engine load when the seventh means determines that the asynchronization fuel injection occurs.

12. A system as set forth in claim 11, wherein the fifth means derives a first correction quantity according to the timing at which the asynchronization fuel injection is carried out when the asynchronization fuel injection occurs so that the eighth means corrects the fuel injection quantity at the subsequent synchronization fuel injection according to the first correction quantity and derives a second correction quantity according to the timing at which the asynchronization fuel injection is carried out so that the ninth means corrects the quantity of fuel injected for each cylinder at the asynchronization fuel injection.

13. A system as set forth in claim 12, wherein the first means comprises an airflow meter for detecting an intake air quantity $Q_a$, a first sensor for detecting an engine revolution speed N and a second sensor for detecting an opening angle TVO of an engine throttle valve and which further comprises tenth means for deriving a smooth quantity of fuel Avtp using the following equations (10) through (12):

$$T_{po}=Q_a/N\times K \quad (10)$$

$$T_rT_p=T_p\times Kflat \quad (11)$$

$$Avtp=T_rT_p\times FLOAD+AvTp_{-1}\times(1-FLOAD)+THSTP \quad (12),$$

wherein $T_{po}$ denotes a presmoothed basic pulsewidth for an injection signal supplied to the sixth means, K denotes a constant, $T_p$ denotes a basic pulsewidth and is derived from a weight mean of $T_{po}$, $T_rT_p$ denotes a flat corrected basic pulsewidth, Kflat denotes a flat air-fuel mixture ratio correction coefficient and is derived on the basis of the engine revolutional speed N and $\alpha-N$ flow quantity Qho ($\alpha-N$ flow quantity denotes an air quantity derived on a basis of the opening angle of the engine throttle valve and engine revolutional speed N), THSTP denotes a delay correction pulsewidth as an $\alpha-N$ flow quantity anticipation correction pulsewidth and is derived as a change quantity for each 10 ms of a value of THSTP based on the $\alpha-N$ flow quantity of intake air Qho, and FLOAD (denotes a weight mean correction factor)=TFLOAD+K2D (only deceleration) and TFLOAD is derived on the basis of flow area AA determined by the opening angle of the throttle valve and (displacement×engine revolutional speed) NVM.

14. A system as set forth in claim 13, wherein the first means includes a third sensor for detecting an engine coolant temperature Tw, wherein the seventh means comprises:

(a) eleventh means for deriving a change rate ΔAvtp of Avtp and determining whether the engine operating condition is an engine acceleration or engine deceleration on the basis of the change rate ΔAvtp; and (b) twelfth means for comparing ΔAvtp with LANSI (a threshold value to determine the asynchronization fuel injection) to determine whether the asynchronization fuel injection should be executed, and wherein the fifth means comprises:

(c) thirteenth means for determining whether the engine falls in an abrupt acceleration on the basis of the change rate of the opening angle of the throttle valve when ΔAvtp≧LANMSI; and (d) fourteenth means for deriving the second correction quantity GZTw and GZCYn (n: cylinder number), wherein GZTw denotes a correction percentage of the coolant temperature for the asynchronization fuel injection for each cylinder and is derived on the basis of the coolant temperature and GZCYn denotes the correction quantity for the fuel injection timing of either GZCYL or GZCLS on the basis of the result of determination of the abrupt acceleration.

15. A system as set forth in claim 14, wherein the ninth means derives the quantity of fuel injected for each cylinder at the asynchronization fuel injection using the following equation (14):

$$INJSETn=\Delta Avtpn\times GZTw\times GZCYn+Ts \quad (14),$$

wherein Ts denotes a correction coefficient for a dead time of a fuel injector constituting the sixth means.

16. A system as set forth in claim 15, wherein the fourth means determines whether the present timing of the asynchronization fuel injection falls in a B range from a suction stroke of one of the engine cylinders to the timing of the synchronization fuel injection or falls in an A range from the timing of the synchronization fuel injection to the subsequent suction stroke of another engine cylinder after the ninth means derives the fuel injection quantity INJSETn at the time of the asynchronization fuel injection.

17. A system as set forth in claim 16, wherein the fifth means derives the first correction quantity ERACIn using the following equation (15) when the fourth means determines that the timing of the asynchronization fuel injection falls in the B range:

$$ERACIn=\Delta Avtpn\times GZTw\times(GZCYn-ERACPH)+ERACIn' \quad (15),$$

wherein ERACIn' denotes a previous value of ERACIn and ERACPH denotes a basic correction percentage for the transfer to the asynchronization fuel injection to compensate for the fuel current of fuel injection quantity flowing toward the wall surface.

18. A system as set forth in claim 17, wherein the fifth means derives the first correction quantity ERACIn using the following equation (16) when the fourth means determines that the timing of the asynchronization fuel injection falls in the A range:

$$ERACIn=\Delta Avtpn\times GZYw\times(GZCYn-ERACP)+ERACIn' \quad (16),$$

wherein ERACP denotes a basic correction percentage for the transfer to the asynchronization fuel injection in which the quantity of fuel flowing toward the wall surface and the increased quantity of the intake air are added to compensate for the increase of the intake air quantity and ERACP>ERACPH.

19. A system as set forth in claim 18, wherein the first means includes a fourth sensor for detecting an air-fuel mixture ratio from an oxygen concentration of an engine exhaust gas and wherein the eighth means derives the quantity of fuel injected at the synchronization fuel injection using the following equation (17):

$$T_i=(Avtp\times\alpha m+Kathos)\times\alpha+Ts+(Chosn-ERACIN) \quad (17),$$

wherein Kathos denotes a correction coefficient for correcting the quantity of fuel of the fuel current flowing toward the wall surface which changes with a relatively slow time constant and is given as a function of Vmf (a speed of the fuel adhered onto the wall surface) and a correction percentage Ghf, $\alpha$ denotes a control correction coefficient of the air-fuel mixture ratio on the basis of an output of the fourth sensor, $\alpha m$ denotes a correction coefficient for the air-fuel mixture ratio learning control, and Chosn denotes the correction quantity for the quantity of fuel flowing toward the wall current for each cylinder and is derived using the following equation (18):

$$Chosn=\Delta Avtpn\times GZTwP \text{ (or GZTwM)} \quad (18),$$

wherein GZTwP denotes the coolant temperature correction coefficient at the time of the engine acceleration and GZTwM denotes the same coefficient at the time of the engine deceleration.

20. A system as set forth in claim 16, wherein the fifth means derives the first correction quantity using the following equation (19):

$$ERACIn = \Delta Avtp \times GZTw \times (GZCYn - ERACPH-) - Avtp + ERACIn' \quad (19),$$

wherein the term of −Avtp is added only when the timing of the asynchronization fuel injection falls in the A range.

21. A system as set forth in claim 1, wherein the fourth means determines whether the engine operating condition falls in a predetermined transient state and derives a timing at which a synchronization fuel injection is started in synchronization with an engine revolution when determining that the engine falls in the predetermined transient state.

22. A system as set forth in claim 21, wherein the first means includes seventh means for detecting the timing T at which the previous synchronization fuel injection timing is started and a sensor for detecting an engine coolant temperature and wherein the fourth means derives the timing T from the result of detection of the seventh means and the fifth means comprises:

(a) eighth means for deriving a first correction coefficient Gzit using the timing T derived by the fourth means;

(b) ninth means for determining whether a change rate Avtp of a smooth quantity of fuel Avtp which corresponds to a smooth quantity of intake air derived on the basis of an output of an airflow meter and on the basis of an opening angle VTO of a throttle valve derived from an opening angle sensor, the airflow meter and opening angle sensors constituting the first means, is more than zero;

(c) tenth means for deriving a first correction quantity Chosn for each cylinder using the following equation (20) when the ninth means determines that $$Avtp < 0: Chosn = \Delta Avtpn \times GZTwn \times Gzit \quad (20);$$

and (d) eleventh means for deriving a second correction quantity Eritn for each cylinder using the following equation (21) when the ninth means determines that $$Avtp < 0: Eritn = \Delta Avtpn \times Gztwn \times (Gzit - ERACPH) \quad (21).$$

23. A system as set forth in claim 22, wherein the fifth means further comprises:

(c) twelfth means for deriving the first correction quantity Chosn for each cylinder using the following equation (22) when the ninth means determines that $$Avtp > 0: Chosn = \Delta Avtpn \times GZTwp \times Gzit \quad (22);$$

and (d) thirteenth means for deriving the second correction quantity Eritn for each cylinder using the following equation (23) when the ninth means determines that $$Avtp > 0: Eritn = \Delta Avtpn \times Gztwp \times (Gzit - ERACPH) \quad (23).$$

24. A system as set forth in claim 23, wherein the third means derives the quantity of fuel Tin using the following equation (24):

$$Tin = (Avtp + Kathos) \times Tfbya \times (\alpha + \alpha m) + Chosn - Eracin' + Ts,$$

wherein Eracin' denotes a previous value of Eracin, Eracin denotes the second correction quantity of Eritn, and Kathos denotes a transient state correction quantity which corresponds to a correction quantity for the quantity of fuel flowing toward the wall surface (wall current) changing with a relatively slow time constant and is given as a function of a speed of the wall current Vmf [ms.] and a correction percentage Ghf [%], and Tfbya denotes a target air-fuel mixture ratio.

25. A system as set forth in claim 24, wherein the third means sets the present smooth quantity of fuel Avtpi (i=the present cylinder number toward which the fuel is injected) as a previous smooth quantity of fuel Avtpin, sets the second correction quantity Eritn to Eracin for the subsequent quantity of fuel Tin, and derives a quantity of fuel Mf flowing toward the wall surface using the following equation (25):

$$Mf = Mf' + Vmf \quad (25),$$

wherein Mf' denotes a previous value of Mf.

26. A system as set forth in claim 1, wherein the fourth means determines whether the engine operating condition falls in a predetermined transient state and derives a timing at which an asynchronization fuel injection is started independently a fuel injection in synchronization with an engine revolution when determining that the engine falls in the predetermined transient state.

27. A system as set forth in claim 26, wherein the first means includes seventh means for detecting an engine revolutional angle at which the asynchronization fuel injection is started, wherein the fourth means derives the timing at which the asynchronization fuel injection occurs on the basis of the engine revolutional angle, and wherein the fourth means comprises: (a) eighth means for deriving a first correction coefficient Czcyn using the timing of the asynchronization fuel injection; (b) ninth means for deriving the quantity of fuel injected at the asynchronization fuel injection Injesten using the following equation (27):

$$Injesten = \Delta Avtpion \times Cztw \times Czcyn + Ts \quad (27),$$

wherein ΔAvtpion denotes a previous value of ΔAvtpn, Cztw denotes a correction coefficient for a coolant temperature detected by a coolant temperature sensor constituting the first means, and Czcyn denotes a correction percentage for the asynchronization fuel injection timing derived by the eighth means.

28. A system as set forth in claim 27, wherein the fourth means further includes tenth means for deriving a correction quantity Eracin for the fuel injection quantity of the synchronization fuel injection using the following equation (20):

$$Eracin = Eracin' + \Delta Avtpoin \times Gztw \times (Gzcyn - Eracp) \quad (28),$$

wherein Eracp denotes a basic correction percentage for the transfer to the asynchronization fuel injection.

29. A system as set forth in claim 25, wherein the sixth means includes a plurality of fuel injectors installed in an intake manifold of each engine cylinder and which injects fuel, the quantity of fuel injected through each fuel injector depending on the quantity of fuel Tin derived by the third means.

30. A system for controlling quantity of supply fuel for an internal combustion engine, comprising:

(a) first means for detecting parameters determining an engine operating condition;
(b) second means for determining whether the engine falls in a transient operating state on the basis of the detected parameters;
(c) third means for deriving a quantity of fuel to be supplied to each engine cylinder on the basis of the detected parameters;
(d) fourth means for deriving a factor which provides a substantially flat characteristic for an air-fuel mixture ratio when the quantity of fuel derived by the third means is injected during the transient operating condition on the basis of the detected parameters;
(e) fifth means for deriving a correction quantity for the quantity of fuel derived by the third means on the basis of the factor derived by the fourth means when the engine falls in the transient operating condition; and
(f) sixth means for supplying the quantity of fuel for each cylinder which is derived by the third means and corrected by the fifth means.

31. A system as set forth in claim 30, wherein the fourth means derives a predicted value of a temperature at a wall surface of an intake air passage onto which part of fuel quantity supplied from the system is adhered and a delay time constant of the temperature on the basis of the detected parameters so that the fifth means derives the correction quantity on the basis of the derived temperature and delay time constant when the engine falls in the transient state.

32. A system as set forth in claim 30, wherein the fourth means derives a timing at which a synchronization fuel injection is executed so that the fifth means derives another correction quantity according to the derived timing of the synchronization fuel injection when the engine falls in the transient state.

33. A system as set forth in claim 30, wherein the fourth means derives whether a timing of a asynchronization fuel injection executed independently of a synchronization fuel injection executed in synchronization with an engine revolution falls in a range between the present suction stroke of one of engine cylinders and the synchronization fuel injection timing executed for the subsequent suction stroke of another engine cylinder when the engine falls a predetermined acceleration so that the correction quantity derived by the fifth means is changed according to the result derived by the fourth means.

34. A system as set forth in claim 1, wherein the transient operating state includes a state in which the engine acceleration occurs, a state in which an engine deceleration occurs, a state in which a fuel supply is resumed immediately after a fuel supply cut off, and a state in which an acceleration immediately after an engine start occurs.

35. A system for controlling quantity of injected fuel to an internal combustion engine, comprising:
(a) first means for detecting an engine operating condition;
(b) second means for deriving a change quantity of an engine load and determining whether the engine falls in a predetermined transient state;
(c) third means for deriving a transient state correction quantity on the basis of the change quantity of the engine load when the engine falls in the predetermined correction quantity;
(d) fourth means for deriving a basic quantity of injected fuel on the basis of the engine operating condition and correcting and outputting the basic quantity of injected fuel by the transient state correction quantity when the engine falls in the predetermined transient state;
(e) fifth means for deriving a factor having a correlation to a quantity of fuel adhered on a wall surface of an intake air passage and having a predetermined time constant when the engine falls in the predetermined transient state and deriving a correction coefficient on the basis of the derived factor;
(g) sixth means for correcting the output fuel injection quantity by the correction coefficient and outputting the corrected fuel injection quantity; and
(h) seventh means for injecting the derived and corrected quantity of fuel toward an intake air passage of the engine.

36. A system as set forth in claim 35, wherein the fifth means derives a predicted value Tf of a temperature at the wall surface of the intake air passage onto which the injected fuel is adhered on the basis of the engine operating condition.

37. A system as set forth in claim 35, which further comprises:
(a) eighth means for determining whether an asynchronization fuel injection independently of a synchronization fuel injection executed in synchronization with an engine revolution should be executed on the basis of the change quantity of the engine load;
(b) ninth means for deriving a quantity of fuel injected at the asynchronization fuel injection on the basis of the change quantity of the engine load when the eighth means determines that the asynchronization fuel injection should be executed;
(c) tenth means for correcting the quantity of fuel injected at the asynchronization fuel injection with a second correction quantity according to a timing of the asynchronization fuel injection with respect to the timing of the synchronization fuel injection and a suction stroke of one of engine cylinders when the asynchronization fuel injection should be executed; and
(d) eleventh means for deriving a third correction quantity for the quantity of fuel injected at the syncronization fuel injection subsequent to the asynchronization fuel injection according to a timing at which the asynchronization fuel injection has occurred with respect to the timing at which the synchronization fuel injection occurs and the timing at which the corresponding suction stroke occurs.

38. A system as set forth in claim 35, which further comprises:
(a) eighth means for deriving a second correction quantity for correcting the basic fuel injection quantity according to a timing at which the fuel injection occurs with respect to a suction stroke of each cylinder and correcting the basic fuel injection quantity by the second correction quantity; and
(b) ninth means for deriving a third correction quantity for correcting the basic fuel injection quantity at the present fuel injection according to the transient correction quantity derived at a previous fuel injection.

39. A method for controlling quantity of supply fuel for an internal combustion engine, comprising the steps of:

(a) detecting parameters determining an engine operating condition;

(b) determining whether the engine falls in a transient operating state on the basis of the detected parameters;

(c) deriving a quantity of fuel to be supplied to each engine cylinder on the basis of the detected parameters;

(d) deriving a characteristic having a correlation to part of the quantity of fuel which has been supplied toward a wall surface of an engine intake air passage, has been adhered onto the wall surface, and will be brought into a combustion chamber of each engine cylinder during its suction stroke at the present fuel supply timing on the basis of the detected parameters;

(e) deriving a correction quantity for the quantity of fuel derived by the third means on the basis of the characteristic derived by the fourth means when the engine falls in the transient operating condition; and (f) supplying the quantity of fuel for each cylinder which is derived in the step (c) and corrected by the correction quantity derived in the step (e).

* * * * *